US009199761B2

(12) United States Patent
McDonald et al.

(10) Patent No.: US 9,199,761 B2
(45) Date of Patent: Dec. 1, 2015

(54) COMPRESSIBLE PACKAGING ASSEMBLY

(71) Applicants: John McDonald, Fallbrook, CA (US); Frank Comerford, Laguna Niguel, CA (US); Myles Comerford, Rancho Santa Fe, CA (US)

(72) Inventors: John McDonald, Fallbrook, CA (US); Frank Comerford, Laguna Niguel, CA (US); Myles Comerford, Rancho Santa Fe, CA (US)

( * ) Notice: Subject to any disclaimer, the term of this patent is extended or adjusted under 35 U.S.C. 154(b) by 0 days.

(21) Appl. No.: 14/086,894

(22) Filed: Nov. 21, 2013

(65) Prior Publication Data

US 2015/0114876 A1 Apr. 30, 2015

Related U.S. Application Data

(63) Continuation-in-part of application No. 14/065,304, filed on Oct. 28, 2013.

(51) Int. Cl.

| | |
|---|---|
| ***B65D 81/05*** | (2006.01) |
| ***B65D 5/50*** | (2006.01) |
| ***B65D 5/36*** | (2006.01) |

(52) U.S. Cl.

CPC ..... *B65D 5/509* (2013.01); *B65D 5/3614* (2013.01); *B65D 81/05* (2013.01)

(58) Field of Classification Search

CPC ..... B65D 1/225; B65D 1/22; B65D 81/05–81/058; B65D 81/107; B65D 81/1075; B31B 7/00; B31B 17/00; B31B 1/60

USPC ..... 206/591, 592, 521, 523, 736; 220/62; 229/117.01, 108, 108.1

See application file for complete search history.

(56) References Cited

U.S. PATENT DOCUMENTS

| | | | |
|---|---|---|---|
| 1,821,692 | A | 9/1931 | Copeland |
| 2,012,131 | A | 8/1935 | Kondolf |
| 2,161,128 | A | 6/1939 | Boyle |
| 2,746,665 | A | 4/1950 | Wiggins |
| 2,617,573 | A | 11/1952 | Nahoom |
| 2,723,796 | A | 11/1955 | Malmgren |
| 2,797,855 | A | 7/1957 | Moore |
| 2,807,265 | A | 9/1957 | Oliva et al. |
| 2,948,455 | A | 8/1960 | Frankenstein |
| 2,956,672 | A | 10/1960 | Kirkpatrick |
| 3,047,137 | A | 7/1962 | Kindseth |
| 3,089,631 | A | 5/1963 | Tyrseck et al. |
| 3,285,493 | A | 11/1966 | Coe et al. |
| 3,326,410 | A | 6/1967 | Asenbauer |
| 3,345,643 | A | 10/1967 | Bradley |
| 3,434,650 | A | 3/1969 | Goings |
| 3,695,421 | A | 10/1972 | Wood |
| 3,706,174 | A | 12/1972 | Young et al. |
| 3,853,220 | A | 12/1974 | Luray |

(Continued)

FOREIGN PATENT DOCUMENTS

| | | |
|---|---|---|
| DE | 299 21 203 | 2/2000 |
| DE | 101 05 487 | 8/2002 |

(Continued)

*Primary Examiner* — Steven A. Reynolds
*Assistant Examiner* — Javier A Pagan
(74) *Attorney, Agent, or Firm* — Knobbe Martens Olson & Bear LLP

(57) ABSTRACT

A packaging container can be configured to include cushioning material and to be foldable between an expanded state in which the container can be used to ship an article and a compressed state in which the container occupies a smaller volumetric space without the article being contained therein. This can reduce shipping costs associated with transporting the empty container.

17 Claims, 15 Drawing Sheets

(56) References Cited

U.S. PATENT DOCUMENTS 3,854,650 A 12/1974 Hanaue
3,899,119 A 8/1975 Roccaforte
3,905,474 A 9/1975 Haibara
3,917,108 A 11/1975 Thurman
3,923,578 A 12/1975 Hair
3,994,433 A 11/1976 Jenkins et al.
4,034,908 A 7/1977 Forbes et al.
4,077,518 A 3/1978 Kisslinger et al.
4,155,453 A 5/1979 Ono
4,335,817 A 6/1982 Bahr
4,606,460 A 8/1986 Luray
4,698,246 A 10/1987 Gibbons et al.
4,801,774 A 1/1989 Hart
4,806,398 A 2/1989 Martin, Jr.
4,830,272 A 5/1989 Wear et al.
4,852,743 A 8/1989 Ridgeway
4,886,299 A 12/1989 Ducorday
4,923,065 A 5/1990 Ridgeway
5,024,536 A 6/1991 Hill
5,029,900 A 7/1991 Axelrod
5,046,659 A 9/1991 Warburton
5,056,665 A 10/1991 Boecker et al.
5,071,009 A 12/1991 Ridgeway
5,076,436 A 12/1991 Bortolani et al.
5,080,497 A 1/1992 Peppiatt
5,183,159 A 2/1993 Hojnacki et al.
5,207,327 A 5/1993 Brondos
5,211,290 A 5/1993 Janus et al.
5,217,159 A 6/1993 Calvert et al.
5,218,510 A 6/1993 Bradford
5,223,121 A 6/1993 Dickie et al.
5,226,542 A 7/1993 Boecker et al.
5,226,734 A 7/1993 Scott et al.
5,251,760 A 10/1993 Smith et al.
5,301,872 A 4/1994 Tusing et al.
5,318,219 A 6/1994 Smith
5,322,168 A 6/1994 Kataoka
5,323,896 A 6/1994 Jones
5,372,257 A 12/1994 Beauchamp et al.
5,388,701 A 2/1995 Ridgeway
5,394,985 A 3/1995 Van Hest
5,405,000 A 4/1995 Hagedon et al.
5,467,916 A 11/1995 Beales
5,474,230 A 12/1995 Yotukura
5,492,223 A 2/1996 Boardman et al.
5,524,789 A 6/1996 Jackman
5,579,917 A 12/1996 Lofgren et al.
5,641,068 A 6/1997 Warner
5,669,506 A 9/1997 Lofgren et al.
5,676,245 A 10/1997 Jones
5,678,695 A 10/1997 Ridgeway
5,694,744 A 12/1997 Jones
5,722,541 A 3/1998 Lofgren et al.
5,731,021 A 3/1998 Spector
5,738,218 A 4/1998 Gonzales
5,769,235 A 6/1998 Keach et al.
5,788,081 A 8/1998 Bates et al.
5,797,493 A 8/1998 Watson
5,803,267 A 9/1998 Tu et al.
5,823,348 A 10/1998 Phillips et al.
5,823,352 A 10/1998 Mena et al.
5,893,462 A 4/1999 Ridgeway
5,894,932 A 4/1999 Harding et al.
5,934,473 A 8/1999 Belshé
5,934,474 A 8/1999 Renninger et al.
5,954,203 A 9/1999 Marconi
5,967,327 A 10/1999 Jones
RE36,412 E 11/1999 Jones
5,975,307 A 11/1999 Harding et al.
5,988,387 A 11/1999 Staal et al.
6,006,917 A 12/1999 Loeffler
6,010,003 A 1/2000 Wilkinson
6,047,831 A 4/2000 Jones
6,073,761 A 6/2000 Jones
6,079,563 A 6/2000 Katchmazenski
6,116,501 A 9/2000 Hupp
6,119,863 A 9/2000 Lofgren et al.
6,119,929 A 9/2000 Rose
6,148,591 A 11/2000 Ridgeway et al.
6,158,589 A 12/2000 Smith et al.
6,164,821 A 12/2000 Randall
6,206,194 B1 3/2001 Beneroff et al.
6,223,901 B1 5/2001 Lofgren et al.
6,289,655 B1 9/2001 Ridgeway et al.
6,302,274 B1 10/2001 Ridgeway
6,308,828 B1 10/2001 Jones
6,311,843 B1 11/2001 Smith et al.
6,311,844 B1 11/2001 Ridgeway et al.
6,325,239 B2 12/2001 Randall et al.
6,364,199 B1 4/2002 Rose
6,398,412 B2 6/2002 Wedi et al.
6,467,624 B1 10/2002 Lofgren et al.
6,488,153 B1 12/2002 Morris
6,675,973 B1 1/2004 McDonald et al.
6,676,009 B1 1/2004 Rose
6,676,293 B2 1/2004 Ferris
6,837,420 B2 * 1/2005 Westerman et al. ..... 229/117.15
6,899,229 B2 5/2005 Dennison et al.
6,920,981 B2 7/2005 Lofgren et al.
6,942,101 B2 9/2005 Lofgren et al.
7,000,774 B2 2/2006 Bryant
7,086,534 B2 8/2006 Roesel et al.
7,114,618 B2 10/2006 Arnold
7,150,356 B2 12/2006 Lofgren et al.
7,192,640 B2 3/2007 Holbert et al.
7,255,261 B2 8/2007 Mesly
7,290,662 B2 11/2007 Lofgren et al.
7,293,695 B2 11/2007 Stier
7,296,681 B2 11/2007 McDonald et al.
7,299,926 B2 11/2007 Russel et al.
7,398,884 B2 7/2008 Stegner et al.
7,452,316 B2 * 11/2008 Cals et al. ..... 493/95
7,654,391 B2 2/2010 Langer et al.
7,669,716 B2 3/2010 Lightner et al.
7,731,032 B2 6/2010 McDonald et al.
7,743,924 B2 6/2010 McDonald et al.
7,753,209 B2 7/2010 McDonald et al.
7,775,367 B2 8/2010 McDonald et al.
7,882,956 B2 2/2011 McDonald et al.
7,931,151 B2 4/2011 McDonald et al.
8,028,838 B2 10/2011 McDonald et al.
8,123,039 B2 2/2012 McDonald et al.
8,177,067 B2 5/2012 McDonald et al.
8,235,216 B2 8/2012 McDonald et al.
8,316,760 B2 11/2012 Berthault
8,408,412 B2 4/2013 Hong
8,499,937 B2 8/2013 McDonald et al.
8,505,731 B2 8/2013 McDonald et al.
8,579,184 B2 11/2013 Pettersson et al.
8,627,958 B2 1/2014 McDonald et al.
8,752,707 B2 6/2014 McDonald et al.
9,067,722 B2 6/2015 McDonald et al.
2001/0047950 A1 12/2001 Beneroff et al.
2003/0034273 A1 2/2003 Auclair
2003/0209463 A1 11/2003 Halpin
2003/0213717 A1 11/2003 Kanai
2003/0234207 A1 12/2003 Koike
2004/0086692 A1 5/2004 Clark
2004/0108239 A1 6/2004 McDonald et al.
2004/0129601 A1 7/2004 Lofgren et al.
2004/0140243 A1 7/2004 Roesel et al.
2004/0178113 A1 9/2004 Lofgren et al.
2005/0011807 A1 1/2005 Dennison et al.
2005/0121354 A1 6/2005 Gillis et al.
2005/0252825 A1 11/2005 Lofgren et al.
2005/0286816 A1 12/2005 Laske
2006/0032777 A1 2/2006 Russell et al.
2006/0042995 A1 3/2006 McGrath et al.
2006/0102515 A1 5/2006 McDonald et al.
2006/0213803 A1 9/2006 Saitou et al.
2006/0285777 A1 12/2006 Howell et al.
2007/0237863 A1 10/2007 Langen
2008/0110788 A1 5/2008 Keiger
2008/0110794 A1 5/2008 Anderson et al.

(56) References Cited

U.S. PATENT DOCUMENTS

| | | | | |
|---|---|---|---|---|
| 2008/0223750 | A1 | 9/2008 | McDonald et al. | |
| 2009/0188833 | A1 | 7/2009 | Klos | |
| 2009/0308880 | A1 | 12/2009 | Sims et al. | |
| 2010/0001056 | A1 * | 1/2010 | Chandaria | 229/198.2 |
| 2010/0200453 | A1 | 8/2010 | Keiger | |
| 2010/0276330 | A1 | 11/2010 | McDonald et al. | |
| 2011/0095076 | A1 | 4/2011 | Knighton | |
| 2011/0139673 | A1 | 6/2011 | Klos | |
| 2012/0193405 | A1 | 8/2012 | McDonald et al. | |
| 2012/0211388 | A1 | 8/2012 | Orgeldinger | |
| 2012/0234723 | A1 | 9/2012 | Klos | |
| 2013/0048533 | A1 | 2/2013 | McDonald et al. | |
| 2013/0091807 | A1 | 4/2013 | McDonald et al. | |
| 2013/0137562 | A1 | 5/2013 | Penttinen et al. | |
| 2013/0284733 | A1 | 10/2013 | Samprathi | |
| 2014/0360913 | A1 | 12/2014 | McDonald et al. | |
| 2015/0114875 | A1 | 4/2015 | McDonald et al. | |

FOREIGN PATENT DOCUMENTS

| | | | |
|---|---|---|---|
| EP | 0 980 334 | | 8/2002 |
| EP | 1 431 196 | | 6/2004 |
| EP | 1 561 693 | | 8/2005 |
| EP | 1 657 166 | | 5/2006 |
| EP | 1 657 167 | | 5/2006 |
| EP | 2 546 170 | | 1/2013 |
| JP | 05-305956 | | 11/1993 |
| JP | 2005-146112 | | 6/2005 |
| SU | 827346 | A1 | 5/1981 |
| WO | WO 00/53499 | | 9/2000 |
| WO | WO 00/64772 | | 11/2000 |
| WO | WO 2007/127243 | | 11/2007 |
| WO | WO 2008/086532 | | 6/2008 |
| WO | WO 2008/115829 | | 9/2008 |
| WO | WO 2013/150312 | | 10/2013 |
| WO | WO 2014/043569 | | 3/2014 |

* cited by examiner

COMPRESSIBLE PACKAGING ASSEMBLY

RELATED APPLICATIONS

The present application claims priority to U.S. application Ser. No. 14/065,304 filed Oct. 28, 2013, entitled COMPRESSIBLE PACKAGING ASSEMBLY, the entire contents of which are hereby expressly incorporated by reference.

BACKGROUND OF THE INVENTIONS

1. Field of the Inventions

The present inventions are directed to compressible packaging assemblies, for example, corrugated cardboard assemblies having compressible cushioning material enclosed therein.

2. Description of the Related Art

A variety of companies ship fully erected ("set up") but empty shipping containers, which may include cushioning material, to customers or end users for returning equipment. For examples, some companies use this technique for facilitating the return of delicate components, such as cable boxes, laptop computers, cell phones, etc. The customer receives the empty box in the mail, inserts the device to return to the company then ships the box to the appropriate location.

While the service does provide convenience to the end user, there can be large costs associated with shipping an empty box. This is because shipping costs are not solely determined by weight. Rather, shipping companies often use a pricing technique known as "dimensional weight" costing. As an example, consider a box having the dimensions of 19"×16"×5.5". Under a "dimensional weight" costing schedule, the above-noted box would be considered to encompass a volume of 1,672 cubic inches. The volume of the box is then divided by a constant, such as 194 cubic inches per pound, resulting in a "dimensional weight" of 8.62 pounds. This fictional weight of the box is then used for pricing the shipping cost based on the standard weight-dependent shipping cost schedules.

SUMMARY OF THE INVENTIONS

An aspect of at least one of the inventions disclosed herein includes the realization that the costs associated with shipping fully erected, empty containers, which is the practice of some companies in the industry, can be significantly reduced by providing a packaging solution that presents an easy-to-use assembly that includes a proper outer shipping container and includes inner cushioning material, but which can be compressed. As such, the shipping solution can be compressed to a reduced volume and sent to a customer with a lower dimensional weight and thus a lower shipping cost. The customer can then open and expand the compressed container, insert the article to be shipped, then close and ship the container in its expanded but closed state. As such, shipping cost penalties associated with shipping a larger empty container can be avoided.

For example, in some of the embodiments disclosed herein, a cushioned shipping container assembly that is configured to provide a 19"×16"×5.5" shipping container can be folded and compressed to a size of 19"×16"×1", when empty. As such, under the dimensional weight costing scenario noted above, the compressed box would occupy a volume of approximately 304 cubic inches. Under the above-noted formula, the volume of 304 inches would be divided by 194 cubic inches per pound, resulting in a fictional weight of 1.57 pounds, which would then be used to calculate the shipping cost of the compressed container under standard weight-based shipping cost schedules. In this example, the compressed box can be shipped at one-fifth of the shipping cost of the empty box noted in the Background section of the present application.

Thus, in accordance with some embodiments, a shipping container assembly comprises an outer shell assembly configured to define a complete outer shell appropriate for shipping and compressible cushion material. The assembly is configured to be folded into a compressed state in which the cushion materials are compressed from their free shape into a compressed state such that the assembly occupies a first volume of space. The assembly is also configured to be foldable to a second state occupying a second volume larger than the first volume, and in which the outer surface of the container is sufficiently continuous to be appropriate for shipping.

Accordingly, as noted above, by providing a shipping solution that can be folded into a compressed state and a second enlarged state, the assembly can be shipped at a lower cost because it occupies a smaller volume when empty and in the compressed state. Additionally, the assembly can be conveniently expanded into a shipping container for containing an article to be shipped. Thus, such a device can save shipping costs.

In accordance with other embodiments, a shipping container can be configured for containing and protecting an article during transportation. The shipping container can comprise an outer container assembly comprising one or more pieces of planar substrate material defining at least a bottom wall and a plurality of side walls connected to the bottom wall. The one or more pieces of planar substrate material can be foldable between a first collapsed configuration in which the bottom and plurality of walls at least partially surround a first volume, and a second deployed configuration in which the bottom and the plurality of side walls at least partially surround a second volume that is larger than the first volumes. At least a first compressible cushion member comprising a compressible material can also be included. The first compressible cushion member can be disposed within the outer container assembly. The first compressible cushion member can also have a size such that when the first compressible cushion member is pressed into a compressed state when the one or more pieces of planar substrate material are in the first collapsed configuration, and wherein the first compressible cushion member is expanded to an expanded state in which the first compressible cushion member is larger than when in the compressed state.

DETAILED DESCRIPTION OF THE PREFERRED EMBODIMENT

An improved packaging assembly is disclosed herein. The packaging assembly, in some embodiments, includes frame portions having compressible cushion material attached hereto and are configured to be foldable into compressed states.

In the following detailed description, terms of orientation such as "upper," "lower," "longitudinal," "horizontal," "vertical," "lateral," "midpoint," and "end" are used herein to simplify the description in the context of the illustrated embodiments. Because other orientations are possible, however, the present inventions should not be limited to the illustrated orientations. Those skilled in the art will appreciate that other orientations of various components described herein are possible.

Figure 1:
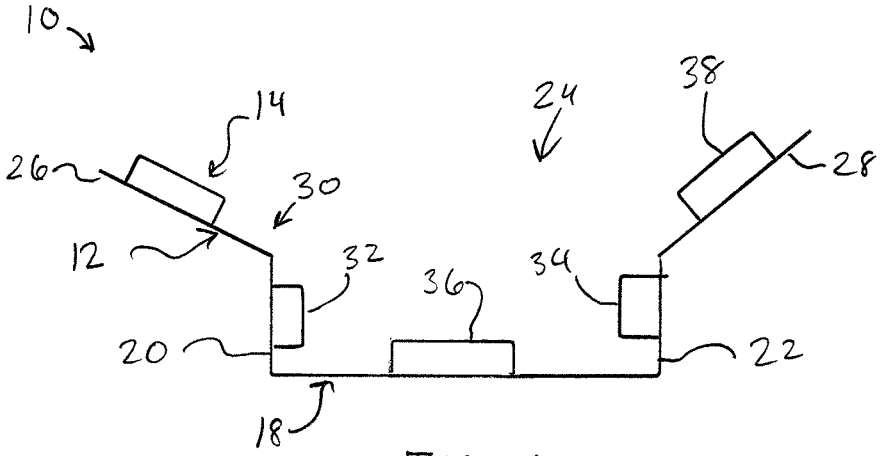
FIG. 1 is a schematic side elevational view of a shipping container having attached cushioning members in an open state.
Figure 2:
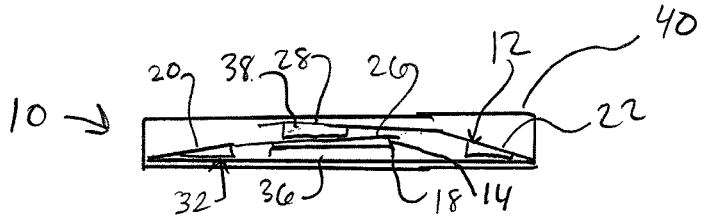
FIG. 2 is a schematic side elevational view of the container of FIG. 1, folded into a compressed state.
Figure 3:
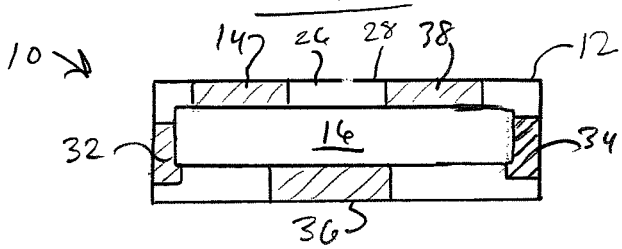
FIG. 3 is a schematic sectional side elevational view of the container of FIG. 1, in an expanded state, closed, and containing an article to be shipped.

With reference to FIGS. 1-3, a compressible shipping container 10 can include an outer portion 12 made from materials that are appropriate for the outer wall of a container that is appropriate for shipping purposes. Additionally, the container 10 can include one or more cushions 14 attached to an inner surface of the outer assembly 12.

The outer assembly 12 can be made from any type of material. Such typical materials can include, but without limitation, paper, cardboard, corrugated cardboard, chipboard, plastic, and other appropriate materials. The material chosen for the outer assembly 12 can be a substantially rigid, but foldable material. It will be appreciated that, although denominated as rigid or substantially rigid, the chosen material would preferable have an amount of flexibility in cases of extreme physical impact, as is well known in the packaging arts. In some embodiments, the outer assembly 12 can be made from one or more pieces of corrugated cardboard. In some embodiments, the material used to form the outer assembly is a single wall, corrugated C-flute cardboard. Other materials and flute sizes can also be used. In some embodiments, the outer assembly 12 can be made from a material having a basis weight of at least about 75 pounds.

In some embodiments, the outer assembly 12 can be formed from a material having any strength, as long as when assembled with an article inside, the combination of the 3 components of the container 10 (the outer assembly 12, the cushions 14 and the article 16) result in a packaging unit able to protect the article from the rigors of commercial shipping, such as with companies including UPS, USPS, FedEx, etc.

The outer assembly 12 can be in the form of any type of configuration of container, such as those containers typically referred to as "boxes." Additionally, the outer assembly 12 can be configured to be foldable between at least two states. Firstly, the outer assembly 12 can be configured to be foldable to an expanded state in which the assembly 12 can be closed to surround or contain an article to be shipped, for example, the article 16 illustrated in FIG. 3. In some applications, the article 16 could be a digital cable box, a laptop computer, a satellite television receiver, etc.

With continued reference to FIG. 1, the assembly 12 can also be configured to be foldable in a compressed state, such as that illustrated in FIG. 2. In FIG. 2, the outer assembly 12 is folded such that the total volume of the outer assembly 12 is smaller than the total volume of the outer assembly 12 illustrated in FIG. 3.

For example, the outer assembly 12 can include a bottom portion 18, a plurality of side walls 20, 22 (only two side walls 20, 22 are shown, but it is to be understood that the assembly 12 can include four side walls). The side walls 20, 22 can all be attached to the bottom 18 so as to form a tray-type configuration, being closed at the bottom 18 and the side walls 20, 22 with an upwardly facing opening 24. Additionally, the container 12 can include lid portions 26, 28, pivotably attached to one or more side walls 20, 22 so as to be movable between an open state (illustrated in FIG. 1) and a closed state (illustrated in FIG. 3).

As noted above, the container 10 can include at least one cushion 14. FIG. 1 illustrates a cushion 14 mounted to an inner surface 30 of the assembly 12, and more particularly, on an inner surface of the lid portion 26. The container 10, in the illustrated embodiment, also includes cushions 32, 34 mounted on the inner surfaces of the side walls 20, 22 and a cushion 36 mounted to an inner surface of the bottom 18. This is merely an example of a configuration of cushions 14 that can be used. Other configurations can also be used.

The cushions 14, 32, 34, 36, 38 can be made from any type of compressible cushion material such as, for example, but without limitation, polyurethane, polyethylene, expanded polypropylene, expanded polystyrene, expanded polyethylene, cross-linked polyethylene, all of which can be fabricated or molded in the desired shapes. Additionally, the cushions can be made from felted polyurethane, thermal-formed plastics, thermal-formed foams, molded air bladders with or without air valves. However, other materials can also be used that can provide a cushion for a packaged item, such as the article 16.

With continued reference to FIG. 1, in the illustrated orientation of the outer assembly 12, the cushions 14, 32, 34, 36, 38, are in a free expanded state and the outer assembly 12 is in an expanded state.

As noted above, and with reference to FIG. 2, the assembly 10 can be configured to be foldable to a compressed state which has a total volume smaller than that occupied by the container in the configuration of FIG. 3. For example, the outer assembly 12 can be configured to be foldable such that the side wall 20 and lid portion 26 can be folded toward the bottom and the side wall 22 and lid portion 28 can be folded on top of the side wall 20 and lid portion 26, and also toward the bottom 18. In such a configuration, the cushions 14, 32, 34, 36, and 38 are compressed as the outer assembly 12 is flattened into the configuration illustrated in FIG. 2.

Being foldable into such a compressed configuration can provide significant advantages. For example, as explained in the Summary of the Invention section, some shipping companies use a "dimensional weight" function for calculating shipping charges. Thus, if the container 10 is folded into the configuration of FIG. 3, and were dimensioned so as to form a container 10 having the dimensions of 19"×16"×5.5", it would occupy a volume of 1,672 cubic inches. Some companies use a dimensional weight function in which the volume of 1,672 cubic inches is divided by a constant of 194 cubic inches per pound. This will result in a "dimensional weight" of 8.62 pounds for the container 10, in the configuration illustrated in FIG. 3.

However, by configuring the container 10 to be foldable into the compressed state illustrated in FIG. 2 where, in some embodiments, the container 10 occupies a space of 19"×16"×1", the resulting total volume occupied by the container 10 would be 304 cubic inches. Dividing this volume 304 inches by the constant 194 cubic inches per pound would result in a dimensional weight of 1.57 pounds. As such, the shipping cost for the container 10 in the configuration of FIG. 2 would be 80% less than the shipping cost of the container 10 in the configuration of FIG. 3.

As such, the container 10 can be shipped to a destination, such as a retail consumer, who needs the package to ship an article 16. The retail user could receive the container 10 in the configuration of FIG. 2, expand the container 10 into the configuration of FIG. 1, add the article 16 through the opening 24, then close the lids 26, 28 so the container is in the configuration of FIG. 3. Then, the end user can ship the article 16 in the container 10, with the cushions 14, 32, 34, 36, 38 supporting and cushioning the article 16.

Optionally, with reference to FIG. 2, an additional securing device 40 can be provided to maintain the container in the compressed configuration of FIG. 2, against any spring effect or bias of the cushions 14, 32, 34, 36, 38. For example, the securing device 40 can be in the form of a plastic strap, staples, string, tape, or sleeve, such as a sleeve made from corrugated cardboard. However, other types of securement devices can also be used.

FIGS. 4-10 illustrate a further embodiment of the container 10 which is identified generally by the reference numeral 100. The container 100 is configured to be foldable between expanded and compressed states, similarly to that of container 10. The description set forth above with regard to the materials and manufacturing techniques of the container 10 apply equally to the container 100.

The container 100 can be formed from one or more pieces of a rigid material so as to form an outer assembly 102 of the container 100. The outer assembly 102 can be formed from any of the materials noted above with regard to the assembly 12, or other materials.

The outer assembly 102 can include a plurality of sections defining different portions of the resulting outer assembly illustrated in FIGS. 5-10. For example, the outer assembly 102 can include end sections 104, 106 and side sections 108 and 110. In the illustrated embodiment, each of the sections 104, 106, 108, 110, include portions for forming parts of a bottom and a top of the container 100. Additionally, the end sections 104, 106 include a portion defining end walls of the container 100. Similarly, the side sections 108, 110 include portions for forming side walls of the container 100.

More specifically, for example, the end sections can include end wall panels 112, 114, bottom panels 116, 118 and lid panels 120, 122 pivotably connected to the lower end upper edges, respectively, of the end wall panels 112, 114. Similarly, the side sections 108, 110 can include side wall panels 124, 126, bottom panels 128, 130 and lid panels 132, 134 pivotably attached to the side walls panels 124, 126, respectively. Optionally, the outer assembly 102 can include a closure tab 136 extending from a side wall portion 110, or another portion of the assembly 102, so as to facilitate fixation of a free edge of the side wall section 110 to a free edge of the end wall section 104, using techniques well known in the art.

Similarly to the container 10, the container 100 can be configured to be foldable between an expanded state and a compressed state. In some embodiments, the assembly 102 can include additional fold lines 140 configured to allow the assembly 102, when in assembled into a box-like configuration, to collapse inwardly during folding of the container 100 from an expanded state to a compressed state.

For example, with reference to the side section 108, the container 100 can include a fold line 142 extending from a lower corner of the side wall panel 124, skewed upwardly and extending onto the top panel 132 to a central area thereof. Additionally, the side section 108 can include a symmetrically arranged fold line 144 extending from the opposite lower corner of the side panel 124 and also extending upwardly towards a central area of the top panel 132. Additionally, the side section 108 can include additional fold lines 146, 148 extending from opposite upper corners of the side panel 124 towards a central area of the top panel 132.

In some embodiments, the top panel 132 can include a U-shaped notch 150 having a bottom or bight section 152 and upwardly extending wings 154, 156. Lower edges of the wings 154, 156 can be spaced apart from each other by the bight section 152. In the illustrated embodiment, the fold lines 142, 146 extend to the left end of the bight 152 and the fold lines 144, 148 extend to the right end of the bight 152. This configuration of fold lines helps facilitate a collapsing, folding movement of the side section 108, which will be described in greater detail below with reference to FIGS. 7-10.

Optionally, the end wall sections 104, 106 can be shaped to further facilitate folding of the container 100 into a collapsed state. For example, the bottom panels 116, 118 can include tapered portions 160, 162. Similarly, the top panels 120, 122 can also include tapered portions 164, 166. The tapered portions 160, 162, 164, 166, can be sized and shaped to provide further clearance during the movement of the container 100 from its expanded state illustrated in FIG. 6 to its compressed state illustrated in FIGS. 9 and 10, described in greater detail below.

Figure 4:
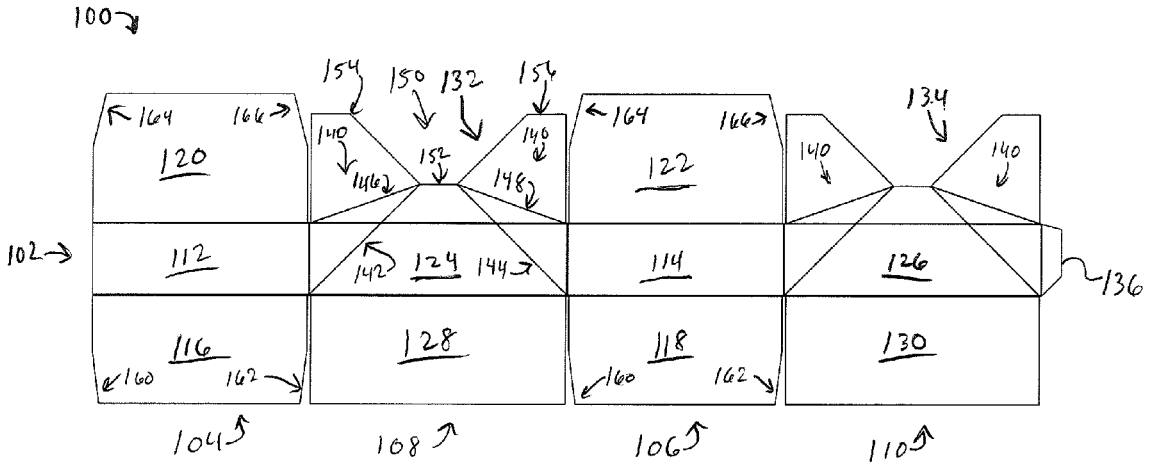
FIG. 4 is a schematic layout of another embodiment of a compressible shipping container.
Figure 5:
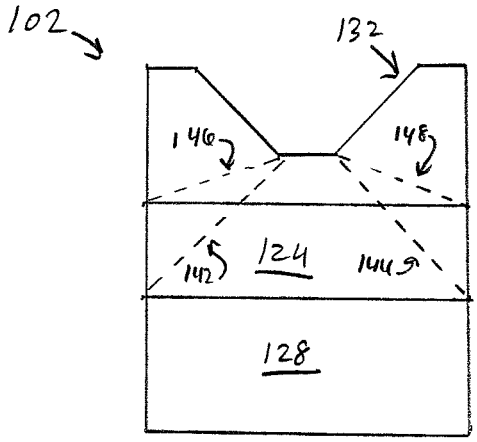
FIG. 5 is a side elevational view of the container of FIG. 4, partially folded into an expanded state.

With continued reference to FIGS. 4 and 5, the assembly 102 can be folded along the fold lines between the end sections 104, 106 and the side sections 108, 110 with the tab portion 136 fixed to the free end of the side panel 112, so as to form a circumferentially closed shape, a side elevational view of which is illustrated in FIG. 5. In FIG. 5, the bottom panels 116, 128, 118 and 130, are not folded, and are extending downwardly, thereby leaving the assembly 102 in a tube-like configuration.

Figure 6:
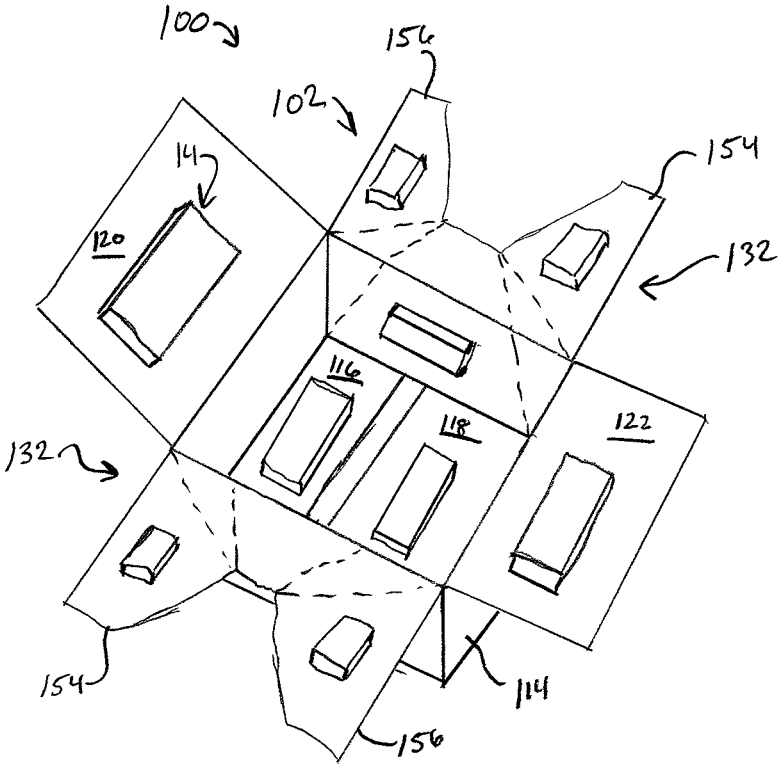
FIG. 6 is a perspective view of the container of FIG. 5, including an example of a layout of cushioning materials attached to various parts thereof.

With reference to FIG. 6, the bottom panels 116, 118, 128, 130 have been folded upwardly so as to close the bottom of the container 100.

With continued reference to FIG. 6, the container 100 can include at least one or more cushions 14. In some embodiments, the cushions 14 can be securely attached to various components of the outer assembly 102. Optionally, one or more cushions 14 can be simply placed inside the open cavity of the container 102 without being adhered or connected to the inner surfaces of the various portions of the assembly 102. For example, in some embodiments, although not illustrated, the container 100 can include four pieces, approximately the same size as the side and end panels 112, 114, 124, 126, as well as a cushion that is approximately the size of the bottom formed by the bottom panels, 116, 118, 128, 130. Additionally, a further top cushion can be included which can be approximately the same size or smaller than the bottom portion noted above. The cushions included, such as the cushion 14, can be made from any of the materials noted above, or other materials.

Figure 7:
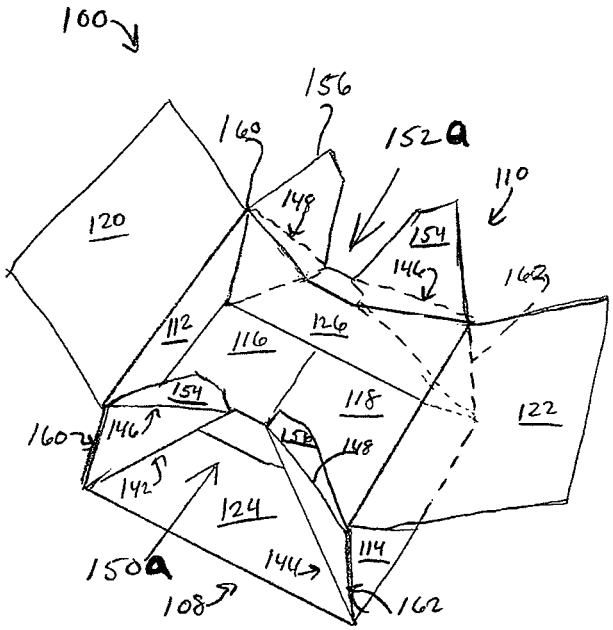
FIG. 7 is a perspective view of the container of FIG. 6, in an intermediate step in the process of compressing the container into a compressed state and with the cushioning material removed.

With reference to FIG. 7, as noted above, the fold lines 142, 144, 146, 148 can be configured to allow the side sections 108, 110 to be collapsed inwardly toward the inner cavity of the container 100. For example, if a force is applied in the direction of the arrows 150*a*, 152*a*, central portions of the side panels 124, 126 can fold inwardly and thus pivot and rotate toward the bottom of the container 100 formed by the bottom panels 116, 118, 128, 130. This movement also causes the end panels 112, 114 to also fold downwardly towards the bottom of the container 100. This movement is similar to the movement of leaves of a blossoming flower or the wings of a bird when a bird moves its wings from an outstretched position to a swept back position.

Additionally, the lateral end portions of the side panels 124, 126 simultaneously pivot along the fold lines 142, 144 and the lateral ends 160, 162 of the side panels 124, 126 where they are attached to the end walls 112, 114. Additionally, the wing portions 154, 156 pivot along the fold lines 146, 148 away from the bottom of the container 100 toward the position illustrated in FIG. 8 (a top plan view). The top panels 120, 122 have been removed from the top plan view of FIG. 8 so as to provide a more clear view of the folding action of the side sections 108, 110.

Figure 8:
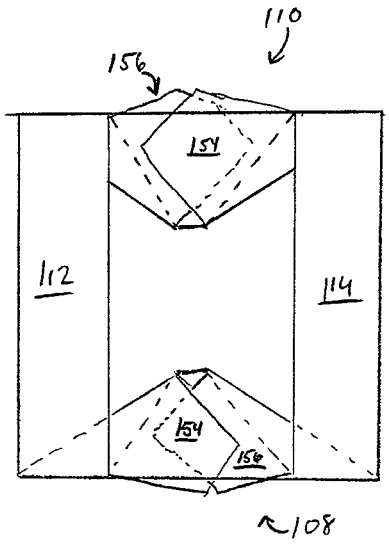
FIG. 8 is a top plan view of the container of FIG. 7, in a further state towards the compressed state.

With continued reference to FIG. 8, the continued movement of those described above with reference to FIG. 7, the wings 154, 156 can be folded on top of each other as the side panels 124, 126 are further moved towards one another. Eventually, as the panels 124, 126 are continued to be folded inwardly, the wings 154, 156 can be folded such that they are contained completely within the footprint of the bottom of the container 100.

Figure 9:
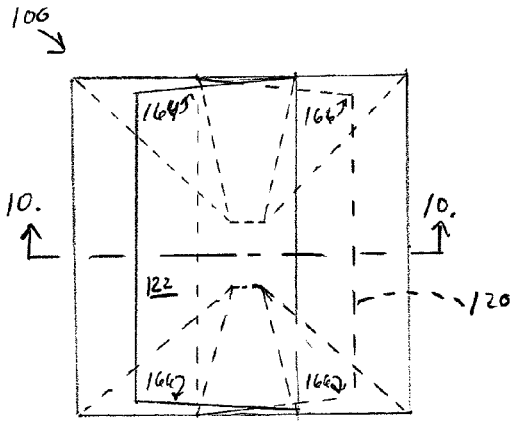
FIG. 9 is a top plan view of the container of FIG. 6, in a fully compressed state.

For example, as shown in FIG. 9, the side panels 124, 126 have been fully folded inwardly and the entirety of the side panels 124, 126 and wings 154, 156 are entirely disposed within the footprint defined by the bottom of the container 100. Additionally, the lid panels 120, 122 can be folded on top of one another, with the tapered portions 164, 166 providing for additional clearance allowing the top panels to be folded one on top of the other.

Figure 10:
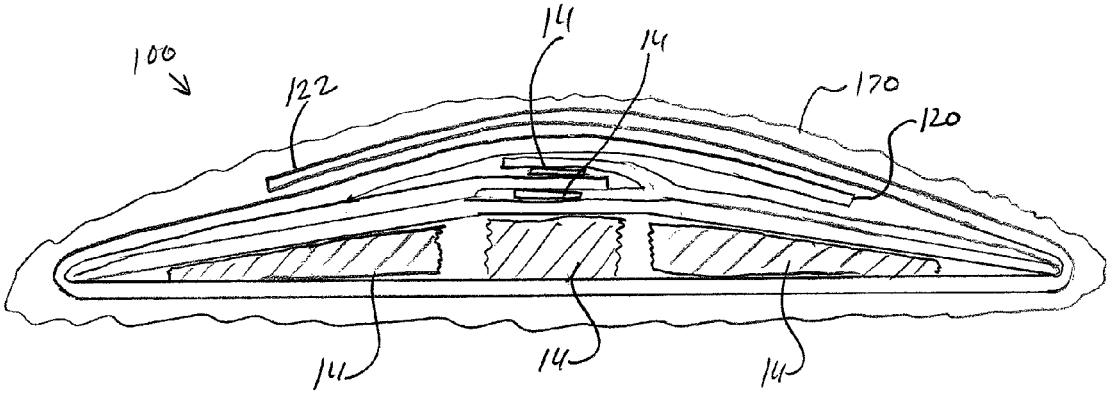
FIG. 10 is a sectional view taken along the line 10-10 of FIG. 9, with the container in a fully compressed state and within a retention member.
Figure 12:
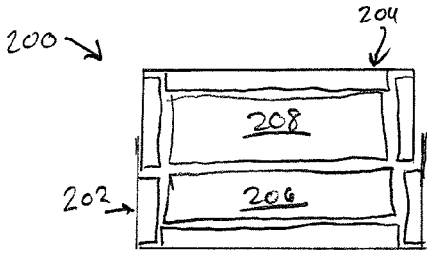
FIG. 12 is a schematic side elevational and sectional view of the container of FIG. 11, with one portion nested into the other.

With reference to FIG. 10, which is a cross-sectional view of the container 100 taken along line 10-10 of FIG. 9, the various panels and portions of the container 100 have been folded one on top of another so as to convert the container and the outer assembly 102 into a compressed configuration, illustrated in FIG. 10, in which the cushions 14 are also compressed from their free expanded state.

As a dimensional example, if the container 100, in the configuration illustrated in FIG. 6, were closed with the top panels 120, 122, 132, 134 folded inwardly so as to form a cubic container, in some embodiments, it can have the dimensions of 19"×16"×5.5". Similarly to the embodiment to the container 10 described above, in the compressed configuration illustrated in FIGS. 9 and 10, the container 100 can have approximate dimensions of 19"×16"×1". As such, the total volume occupied by the container is reduced by approximately 80%.

Optionally, the container 100 can be secured into the fully compressed orientation illustrated in FIGS. 9 and 10 with a securement device 170. The securement device 170 can be the same or similar to the securement device 40 noted above. In some embodiments, the securement device 170 can be the type of device which is acceptable to have on the outside of a container for shipping through commercial shipping providers. Thus, the securement device 170 can be a sleeve made out of corrugated cardboard, a strap, a string, tape, etc. In some embodiments, the securement device 170 can be a plastic envelope and vacuum sealed so as to provide additional compressive force.

With reference to FIGS. 11-16, a further embodiment of the containers 10, 100 is illustrated therein and identified by the reference numeral 200. The descriptions set forth above with regard to the containers 10 and 100 with regard to the materials used therefore also apply to the container 200.

The container 200, in some embodiments, can be formed from two nesting portions 202, 204. The nesting portions 202, 204 can have any shape, and in some embodiments, can each form an open trough-type shape. Additionally, similar to the containers 10 and 100, the outer surfaces or walls of the nesting portions 202, 204 can be made from any of those materials that are appropriate for forming containers shipped through commercial shipping providers—for example, single-layer C-flute corrugated cardboard. Other materials can also be used.

The nesting portions 202, 204 can include an arrangement of cushions 206, 208 disposed therein. In some embodiments, optionally, the cushions 206, 208 can be fixed to the inner surfaces of the nesting portions 202, 204. The cushions 206, 208 can be made from any of the materials noted above with regarding to the cushions 14. Other materials can also be used.

Figure 11:
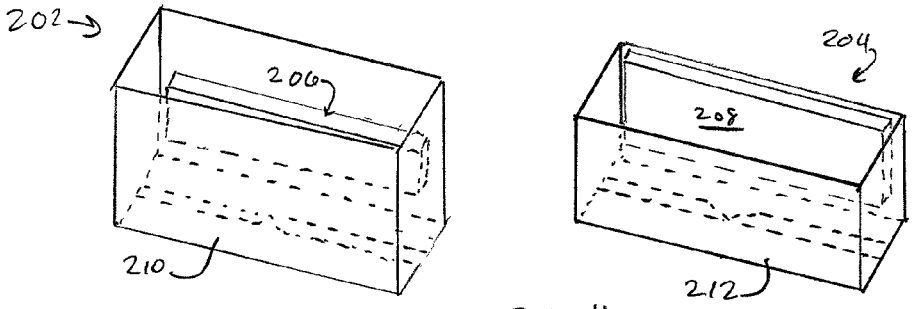
FIG. 11 is an exploded perspective view of a compressible shipping container having two portions that are nestable with each other.

As shown in FIG. 11, the cushion 208 can extend substantially along the entire height of the nesting portion 204. In contrast, the cushion 206 can extend only partly up the height of the nesting portion 202. Additionally, the outer dimensions of the nesting portion 204 can be slightly smaller than that of the outer dimensions of the nesting portion 202. As such, the nesting portion 204 can be nested into the nesting portion 202 into the configuration illustrated in FIG. 12 so as to form a closed shipping container appropriate for shipping an article. The reduced height of the cushion 206 compared to the height of the cushion 208 provides clearance for the nesting of the nesting portion 208 to be inserted into the portion 202.

Figure 13:
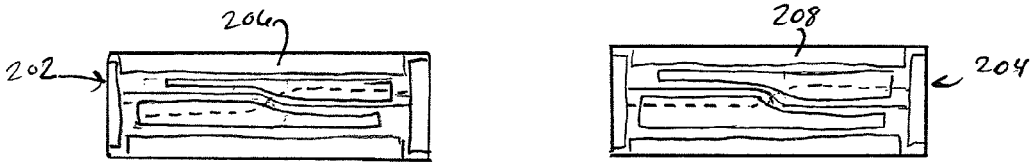
FIG. 13 is a top plan view of the two portions of the container of FIG. 11.

FIG. 13 illustrates side-by-side top plan views of the nesting portions 202, 204. As illustrated, the bottoms 210, 212 of each of the nesting portions 202, 204 include a split overlapping configuration which allows the bottoms 210, 212 to be moved between opened and closed states. This type of configuration is well known in the corrugated cardboard industry as both an "auto bottom box (or tray)" and a "snap lock bottom box (or tray)".

Figure 14:
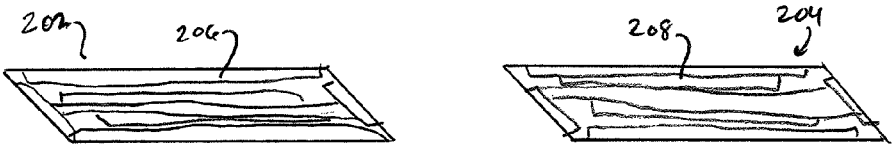
FIG. 14 is a top plan view of the two portions illustrated in FIG. 13, being shifted into a racked position.
Figure 15:
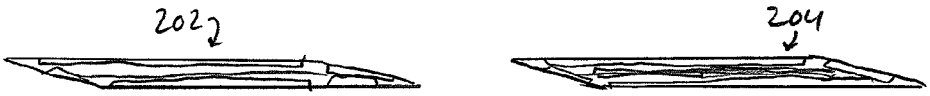
FIG. 15 is a further top plan view of the two portions of the container illustrated in FIG. 14, being further racked into a folded and compressed state.

Additionally, the split configuration of the bottoms 210, 212 allow the nesting portions 204, 206 to be "racked", as illustrated in FIGS. 14 and 15. This racking movement of the nesting portions 204, 206 allows the nesting portions 204, 206 to be moved between the expanded state, illustrated in FIGS. 11 and 12, and a compressed state, illustrated in FIGS. 15 and 16. In the compressed states of FIGS. 15 and 16, the nesting portions 202, 204 have been racked until the cushions 206, 208, as well as any other cushions that may be included on the bottoms 210, 212, are compressed. Additionally, the split configuration of the bottoms 210, 212 allow the bottom panels to fold upwardly and into the interior of the nesting portions 202, 204 so as to fold up against the side walls of the nesting portions 202, 204. As such, the bottoms 210, 212 of each of the nesting portions 204, 206 generally fold such so that they lie parallel to the side walls of the nesting portions 202, 204. Further, the cushions 206, 208 are compressed. This provides the advantage of reducing the overall volume of the container 200 as compared to the configuration illustrated in FIGS. 11 and 12.

Figure 16:
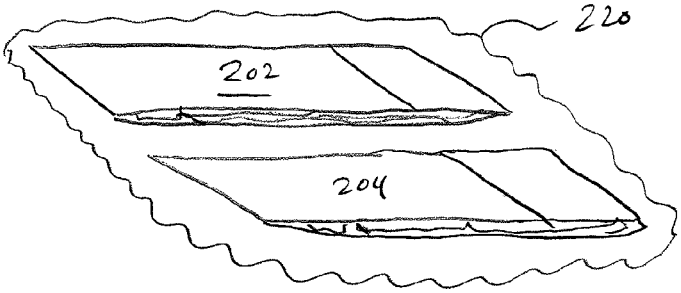
FIG. 16 is a perspective view of the two portions illustrated in FIG. 15, and packaged together.

With reference to FIG. 16, the nesting portions 202, 204, in their compressed states, can be packaged together with a packaging member 220 designed to retain the nesting portions 202, 204 in their compressed state and so that they can be shipped or transported together in a single package. For example, the member 220 can be in the form of a sleeve of corrugated cardboard, a strap, a string, tape, or a plastic envelope used for vacuum packaging.

Figure 17:
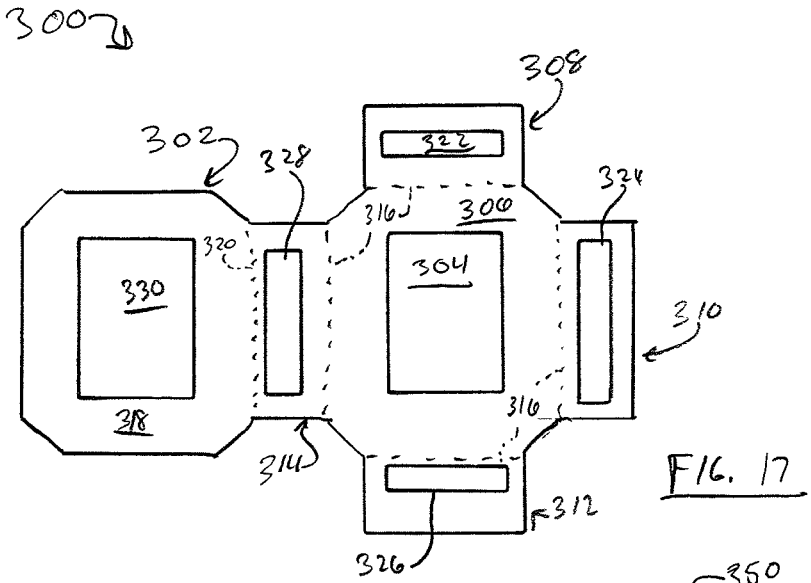
FIG. 17 is a plan view of another embodiment of a compressible shipping container having cushion materials attached thereto.

FIGS. 17-20 illustrate yet another embodiment of a compressible packaging assembly. As shown in FIG. 17, the packaging assembly 300 can include a base member 302 divided into various panels and one or more cushions 304. The base member 302 can be in the form of a rigid frame member made from materials such as those used for the assemblies 12, 102 noted above, or other flexible materials such as flexible plastic skins. For example, in some embodiments, the entire packaging assembly 300 can be made entirely from cushion material, either molded or fabricated. Additionally, regardless of whether it is made from molded or fabricated cushion materials, one or more flexible skins can be attached to one or more surfaces of the cushion materials or the base member 302. Such a skin can help in folding and can also add strength or rigidity to the packaging assembly 300.

In the illustrated embodiment, the base member 302 is formed into a plurality of panels including a bottom panel 306, a plurality of side panels 308, 310, 312, 314, all of which are attached to the bottom portion 306 along fold lines 316. Additionally, the base member 302 includes a top panel 318 attached to the side panel 314 along a fold line 320.

In some embodiments, the base member 302 also includes at least one cushion member 304. The cushion 304 can be in the form of any of the cushions noted above, such as the cushion 14. In some embodiments, the packaging assembly 300 includes a cushion for each of the panels of the base member 302. In the illustrated embodiment, the packaging assembly 300 includes cushions 322, 324, 326, 328, 330.

In this configuration, the packaging assembly 300 can be inserted into a generic box 332 so as to provide cushioning on the bottom, top, and all side walls for an article to be placed therein.

Figure 18:
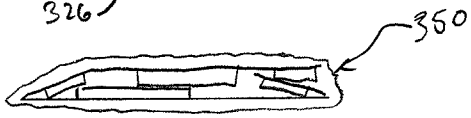
FIG. 18 is a schematic side elevational view of the container of FIG. 17, folded into a compressed state.
Figure 19:
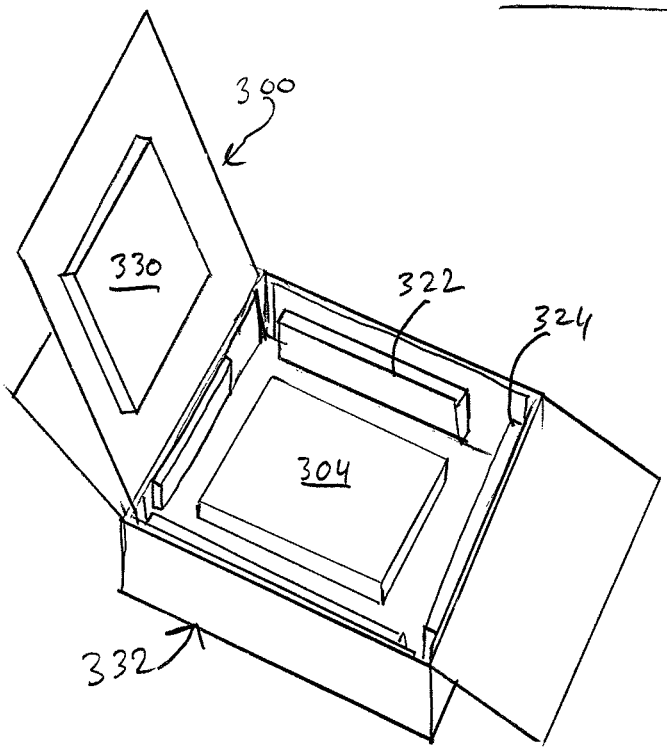
FIG. 19 is a perspective view of the container of FIG. 17, inserted into another box in an open state.

Additionally, with reference to FIG. 18, the packaging assembly 300 can be folded into a compressed state. For example, the panels 308, 310, 312, 314 can all be folded inwardly over the bottom panel 306. Additionally, the top panel 318 can also be folded over the bottom panel 306 so as to compress the various cushions 304, 322, 324, 326, 328, 330, as illustrated in FIG. 18. This can provide the advantage of providing a compact configuration such that the packaging assembly 300 can be shipped at a reduced shipping rate where the dimensional weight function described above provides a reduced shipping cost. In some embodiments, the packaging assembly 300 can be contained within a securement device 350 so as to retain the packaging assembly 300 into its compressed configuration, illustrated in FIG. 18. For example, in some embodiments, the containment device 350 can be a cardboard sleeve, a string, a strap, staples, tape, or an envelope for vacuum sealing.

Figure 20:
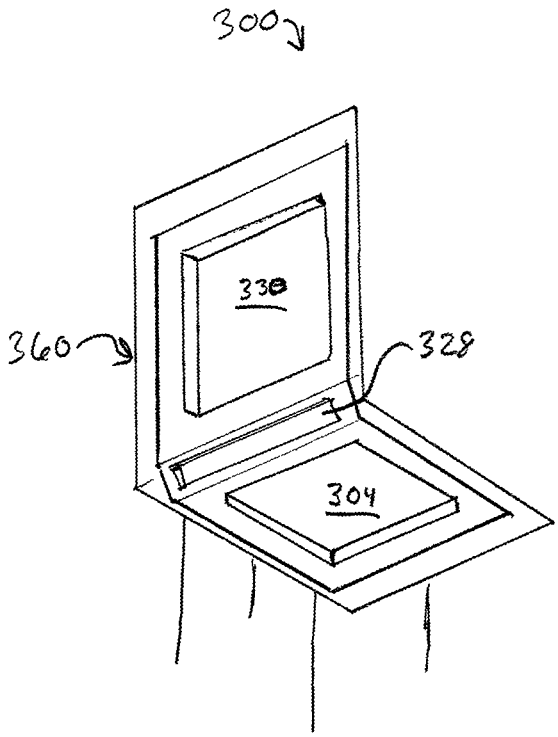
FIG. 20 is an illustration of a modification of the embodiment of FIGS. 17-19, with certain portions removed and converted into a seat cushion.

With reference to FIG. 20, the packaging assembly 300 can also be repurposed for other uses. For example, as shown in FIG. 20, the insert 300 has been modified such that the panels 308, 310, 312 have been cut off along the fold lines 316. As such, the packaging assembly 300 becomes generally the configuration of a seat pad that can be placed on a chair 360 and thereby provide cushioning for a user of the chair 360.

Figure 21:
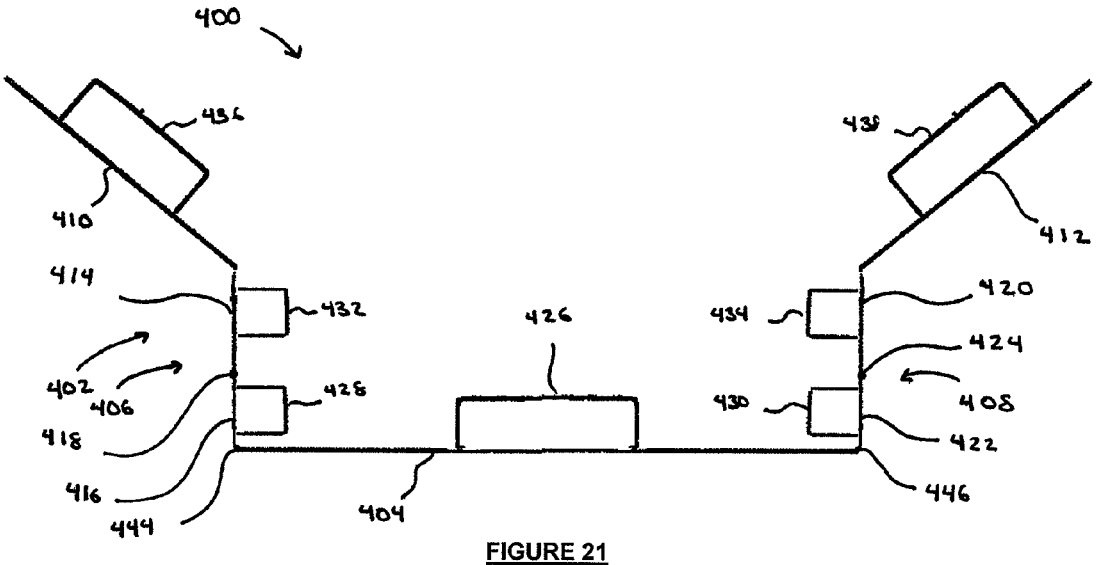
FIG. 21 is a schematic side elevational view of another embodiment of a shipping container, having attached cushioning members, in an open, expanded state.
Figure 22:
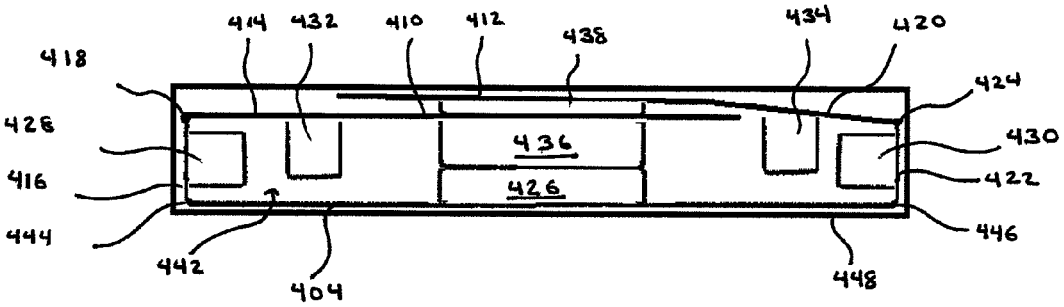
FIG. 22 is a schematic side elevational view of the shipping container of FIG. 21, in a compressed state.
Figure 23:
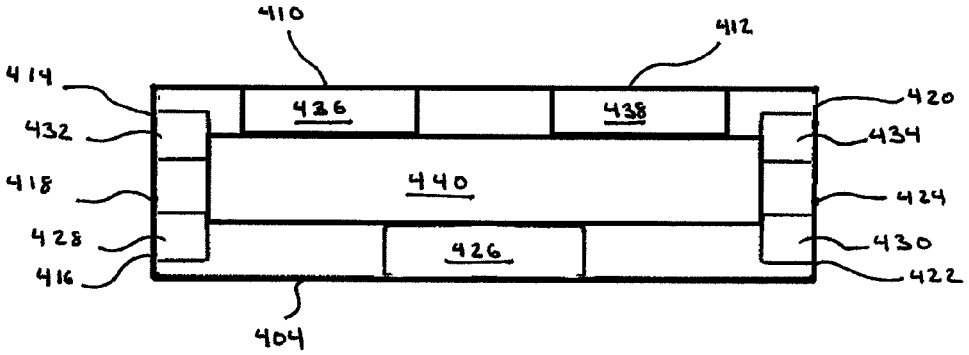
FIG. 23 is a schematic sectional side elevational view of the shipping container of FIG. 21, in a closed, expanded state, and containing an article.

With reference to FIGS. 21-23, a further embodiment of the containers 10, 100 is illustrated therein and identified by the reference numeral 400. The descriptions set forth above with regard to the containers 10, 100 with regard to the materials used, such as materials used for the outer assemblies 12, 102 and corresponding cushions, therefore also apply to the container 400. As shown in the illustrated embodiment, the container can include an outer assembly 402 having a bottom portion or wall 404, a plurality of side walls 406, 408 (only two side walls 406, 408 are shown, but it is to be understood that the assembly outer assembly 402 can include four side walls), and a plurality of top portions or walls 410, 412 (only two lid portions 410, 412 are shown, but it is to be understood that the assembly outer assembly 402 can include four lid portions). Furthermore, in some embodiments, the container 400 can include multiple cushions. As described in greater detail below, the plurality of side walls can be separated into multiple portions by a fold line. For example, as shown in the illustrated embodiment, side wall 406 can be separated into an upper portion 414 and a lower portion 416 by fold line 418 and side wall 408 can be separated into an upper portion 420 and a lower portion 422 by fold line 424.

In some embodiments, the container 400 can include multiple cushions. In some embodiments, the cushions can be attached directly to the outer assembly 402 or can be held in place by the shape of the cushions. As shown in the illustrated embodiment, cushion 426 can be attached to the bottom portion 404, cushions 428, 430 can be attached to the lower portions 416, 422, cushions 432, 434 can be attached to the upper portions 414, 420 and cushions 436, 438 can be attached to lid portions 410, 412. Other cushioning arrangements are also possible. The cushions 426, 428, 430, 432, 434, 436, 438 can provide support for an article 440 placed in the container 400 and protect the article 440 from damage caused by shocks and other forces during transport. For example, such articles could be a digital cable box, a laptop computer, a satellite television receiver, etc.

As with the embodiments described herein, the container 400 can have two general states of operation—an expanded state and a compressed state. With reference to FIGS. 21 and 23, the container 400 is shown in an expanded state. With reference to FIG. 21, in the illustrated orientation of the outer assembly 402, the cushions 426, 428, 430, 432, 434, 436, 438 are in a free expanded state and the outer assembly 402 is in an expanded state with the lid portions 410, 412 in an open position to receive an article 440 to be packaged therein. With reference to FIG. 23, in the illustrated orientation of the outer assembly 402, the cushions 426, 428, 430, 432, 434, 436, 438 are in a partially compressed state and the outer assembly 402 is in an expanded state with the lid portions 410, 412 in a closed position to secure an article 440 to be packaged therein.

With reference to FIG. 22, the container 400 is shown in a compressed state. As shown in the illustrated embodiment, the outer assembly 402 can be configured to be foldable such that the upper portion 414 of side wall 406 and the lid portion 410 can be folded toward the bottom portion 404. Similarly, the upper portion 420 of side wall 408 and the lid portion 412 can be folded toward the bottom portion 404. As shown in the illustrated embodiment, the upper portion 420 of side wall 408 and the lid portion 412 can be folded on top of the lid portion 410 and, in some embodiments, the upper portion 414 of side wall 406. In such a configuration, optionally, some cushions, such as cushions 426, 436, 438 can be compressed as the outer assembly 402 is flattened into the configuration illustrated in FIG. 22. While in the compressed state, container 400 advantageously occupies a lower total volume than in the expanded states as shown in FIGS. 1 and 3. This lower volume allows more of such containers 400 to be stored in a given amount of storage space. However, the cushions can also be configured, sized, and/or arranged such that they are not compressed when the outer assembly 402 is flattened into the configuration illustrated in FIG. 22.

When in the compressed state, container 400 can form a "reservoir" volume 442 with a plurality of side walls formed by the lower portions 416, 422 of side walls 406, 408 (only two lower portions 416, 422 of side walls 406, 408 are shown, but it is to be understood that the "reservoir" volume 442 can include four side walls with lower portions) and the bottom formed by the bottom portion 404. This "reservoir" volume 442 can be created by folding upper portions 414, 420 of the side walls 406, 408 inwardly along the fold lines 418, 424 towards the bottom portion 404. Accordingly, the height of the "reservoir" volume can, in some embodiments, be approximately the distance between the lower edges 444, 446 and the fold lines 418, 424. For example, in some embodiments, this height can be 1.25." Of course, the lower portions 416, 422 need not be completely vertical and can be angled either outwardly from the bottom portion 404 or inwardly towards the bottom portion 404.

By forming a "reservoir" volume 442 when the container 400 is in a compressed state, the container 400 is subject to reduced stresses that would exist without such a feature. For example, the cushions contained within the "reservoir" volume 442 are subject to less compression or no compression at all. For example, cushions 428, 430, 432 and 434 can be sized and arranged so that they are subject to no compression. In addition, cushions 426, 436, 438 can be subject to less compression than might be the case without a "reservoir" volume 442.

As should be noted, even without cushions, the "reservoir" volume 442 can reduce stresses by providing more space for overlapping portions of the container 400. For example, as shown in FIG. 22, lid portions 410, 412 can overlap above the "reservoir" volume 442. Furthermore, other lid portions (not shown) as well as portions of the side walls (not shown) can also overlap above the "reservoir" volume 422. Without being bound by any particular theory of operation, the provision of a "reservoir" volume 442 can allow some overlapping portions to move downwardly into the "reservoir" volume 442 while some overlapping portions can be above the "reservoir" volume 442. In contrast, without a "reservoir" volume 442, all overlapping portions would not be granted the additional space to relieve stress and would pile in a single direction upwardly.

The "reservoir" volume 442 can result in lower stresses being applied to the container, especially along folds such as folds 418, 424, 444, 446 while in the compressed state. The reduction in stress can reduce wear and tear on the container 400 allowing the container 400 to be used more frequently. Furthermore, the decreased compression of the cushions afforded by the "reservoir" volume 442 can reduce the likelihood that the cushions will plastically deform particularly when the container 400 is placed in a compressed state for prolonged periods of time. Plastic deformation of cushions can reduce the effectiveness of the cushions in absorbing shocks and other forces applied to an article 440 to be packaged in the container. Accordingly, inclusion of the "reservoir" volume 442 can advantageously enhance the shelf life of cushions and of the container 400. As such, this feature can significantly reduce total costs to the end user and reduce the amount of waste due to discarding worn containers.

Furthermore, provision of a "reservoir" volume 442 can reduce the force needed to fold the container 400 into a compressed state due to reduced compression and stresses applied to the container 400 when the container 400 is in a compressed state. Accordingly, this can also subsequently reduce the force needed to maintain the container 400 in the compressed state. As should be apparent, this can beneficially facilitate use of the container 400 by an end user. Furthermore, a less robust securing device 448 can be used to maintain the container in the compressed state of FIG. 22, against any spring effect or bias of the cushions 426, 436, 438 or of the outer assembly 402 itself. The optional securing device 448 can be in the form of a plastic strap, staples, string, tape, or sleeve, such as a sleeve made from corrugated cardboard. However, other types of securing devices can also be used.

Moreover, as can be seen in FIG. 22, the container 400 can take on a more rectangular shape. While the total overall volume taken by container 400 can be equal to, or even greater than, a similar container having no "reservoir" volume 442, a rectangular shape can be easier to store when multiple containers are placed adjacent to each other. A rectangular shape also provides a cleaner look when multiple containers are placed adjacent to each other.

As should be apparent, in some embodiments, the bottom portion 404 can remain relatively unaltered or moved during the transition from the expanded state to the compressed state.

FIGS. 24-30 illustrate a further embodiment of the containers 10, 100, 400 which is identified generally by the reference numeral 500. The container 500 is configured to be foldable between expanded and compressed states, similarly to that of containers 10, 100, 400. The description set forth above with regard to the materials and manufacturing techniques of the containers 10, 100, 400 apply equally to the container 500.

The container 500 can be formed from one or more pieces of a rigid material so as to form an outer assembly 502 of the container 500. The outer assembly 502 can be formed from any of the materials noted above with regard to the assemblies 12, 112, 402, or other materials.

The outer assembly 502 can include a plurality of sections defining different portions of the resulting outer assembly illustrated in FIGS. 24-30. For example, the outer assembly 502 can include end sections 504, 506 and side sections 508, 510. In the illustrated embodiment, each of the sections 504, 506, 508, 510 include portions for forming parts of a bottom and a top of the container 500. Additionally, the end sections 504, 506 include a portion defining end walls of the container 500. Similarly, the side sections 508, 510 include portions for forming side walls of the container 500.

Figure 24:
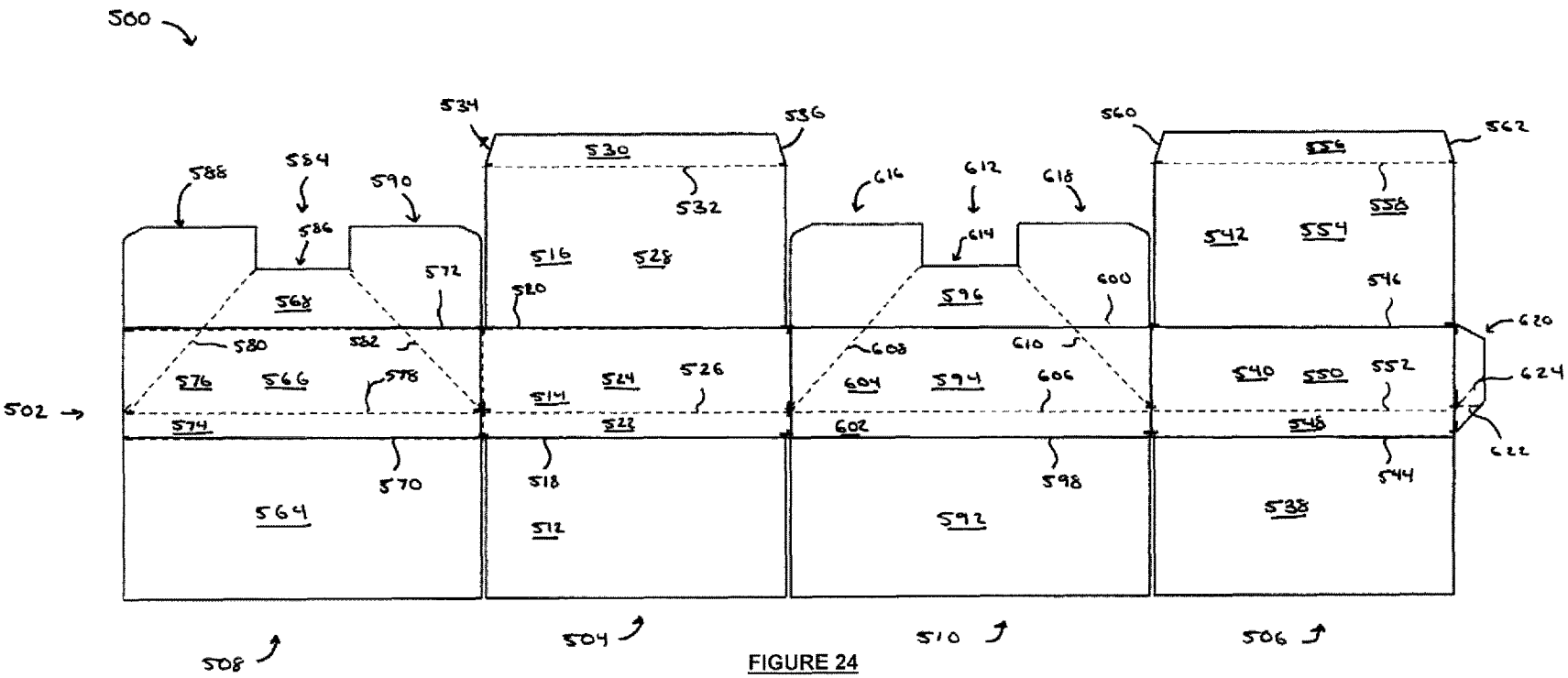
FIG. 24 is a schematic layout of another embodiment of a shipping container in a configuration pre-assembly.

With continued reference to FIG. 24, the end section 504 can include a bottom panel 512, an end wall panel 514, and a lid or top panel 516 with the bottom panel 512 pivotably connected to the lower edge 518 and the lid panel 516 pivotably connected to the upper edge 520. Additionally, as shown in the illustrated embodiment, the end wall panel 514 can be separated into a lower portion 522 and an upper portion 524 by fold line 526. As discussed above with respect to FIGS. 20-23, the existence of a fold line along a side wall or end wall, such as fold line 526, can result in the creation of a "reservoir" volume when the container 500 is in a compressed state. The lid panel 516 can also be separated into a lower portion 528 and an upper portion 530 via fold line 532. This can allow the lid panel 516 to more easily fold when converting the container 500 from an expanded state to a compressed state. This can be particularly beneficial when there is some slight interference between lid panel 516 and the opposing lid panel. In some embodiments, the lid panel 516 can include tapered portions 534, 536 which can be sized and shaped to provide further clearance during the movement of the container 500 from an expanded state to a compressed state and vice versa. Such tapered edges (not shown) can also be included on the bottom panel 512.

The construction of end section 506 can be similar to that of end section 504. End section 506 can include a bottom panel 538, an end wall panel 540, and a lid or top panel 542 with the bottom panel 538 pivotably connected to the lower edge 544 and the lid panel 542 pivotably connected to the upper edge 546. The end wall panel 540 can be separated into a lower portion 548 and an upper portion 550 by fold line 552. The lid panel 542 can also be separated into a lower portion 554 and an upper portion 556 via fold line 558. In some embodiments, the lid panel 542 can have tapered portions 560, 562. Although not shown, the bottom panel 538 can also have tapered portions (not shown).

With continued reference to FIG. 24, the side section 508 can include a bottom panel 564, a side wall panel 566, and a lid or top panel 568 with the bottom panel 564 pivotably connected to the lower edge 570 and the top panel 568 pivotably connected to the upper edge 572. As shown in the illustrated embodiment, the side wall panel 566 can be separated into a lower portion 574 and an upper portion 576 by fold line 578.

Similarly to the containers 10, 100, 400 the container 500 can be configured to be foldable between an expanded state and a compressed state. In some embodiments, the assembly 502 can include additional fold lines configured to allow the assembly 502, when in assembled into a box-like configuration, to collapse inwardly during folding of the container 500 from an expanded state to a compressed state.

For example, with reference to the side section 508, the container 500 can include a fold line 580 extending from a lower corner of the upper portion 576 of side wall panel 566, skewed upwardly and inwardly, the fold line 580 extending onto the top panel 568 to a central area thereof. Additionally, the side section 508 can include a symmetrically arranged fold line 580 extending from the opposite lower corner of the upper portion 576 of side wall panel 566 towards a central area of the top panel 568. As shown in the illustrated embodiment of FIG. 24, the fold lines 580, 582 can extend to opposite lower corners of a notch or cutout 584 in the top panel 568.

As noted above, the top panel 568 can include a rectangular notch or cutout 584 having a bottom or bight section 586 and upwardly extending wings 588, 590. Lower edges of the wings 588, 590 can be spaced apart from each other by the bight section 586. As shown in the illustrated embodiment, the fold line 580 can extend to the left end of the bight section 586 and the fold line 582 can extend to the right end of the bight section 586. As will be described in further detail below with reference to FIGS. 27-30, this configuration of fold lines helps facilitate a collapsing, folding movement of the side section 508.

The construction of side wall section 510 can be similar to that of side wall section 508. The side wall section 510 can include a bottom panel 592, a side wall panel 594, and a lid or top panel 596 with the bottom panel 592 pivotably connected to the lower edge 598 and the top panel 596 pivotably connected to the upper edge 600. As shown in the illustrated embodiment, the side wall panel 594 can be separated into a lower portion 602 and an upper portion 604 by fold line 606. The side section 508 can include a fold line 608 extending from a lower corner of the upper portion 604 of side wall panel 594, skewed upwardly and inwardly, and extending onto the top panel 596. Additionally, the side section 510 can include a symmetrically arranged fold line 610 extending from the opposite lower corner of the upper portion 604 of side wall panel 594.

The top panel 596 can include a rectangular notch or cutout 612 having a bottom or bight section 614 and upwardly extending wings 616, 618. Lower edges of the wings 616, 618 can be spaced apart from each other by the bight section 614. As shown in the illustrated embodiment, the fold line 608 can extend to the left end of the bight section 614 and the fold line 610 can extend to the right end of the bight section 614.

Optionally, the outer assembly 502 can include a closure tab 620 extending from an end section 506, or another portion of the assembly 502, so as to facilitate fixation of a free edge of the end section 506 to a free edge of the side wall section 508, using techniques well known in the art. The closure tab 620 can include a fold line 622 corresponding to fold lines 578 so that, when fixated, the closure tab 620 does not interfere with folding along fold lines 578. Additionally, the closure tab 620 can include a fold line 624 corresponding to fold line 580 so that, when fixated, the closure tab 620 does not interfere with folding along fold line 580.

Figure 25:
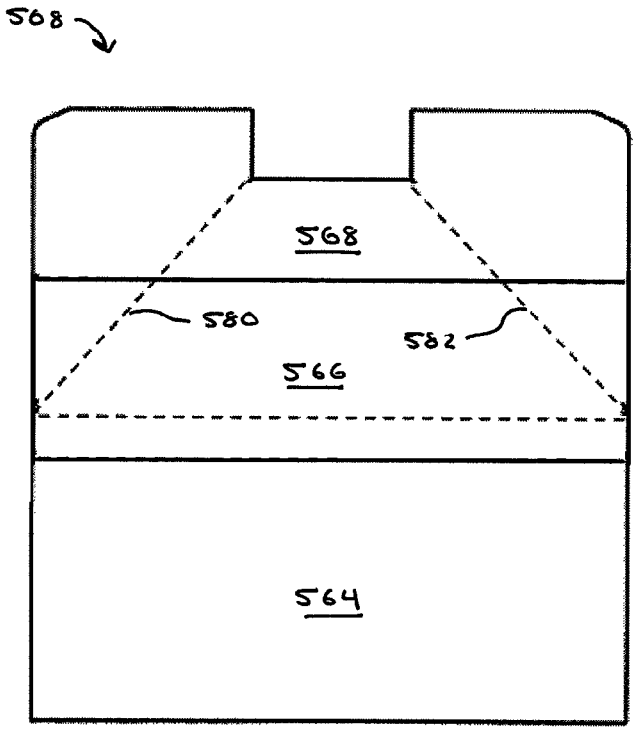
FIG. 25 is a side elevational view of the shipping container of FIG. 24, partially folded into an expanded state.

With reference to FIGS. 24 and 25, the assembly 502 can be folded along the edges between the end sections 504, 506 and the side sections 508, 510 with the closure tab 620 fixed to the free end of the side wall panel 566, so as to form a circumferentially closed shape, a side elevational view of which is illustrated in FIG. 25. In FIG. 25, the bottom panels 512, 538, 564, 592 are not folded, and are extending downwardly, thereby leaving the assembly 502 in a tube-like configuration.

Figure 26:
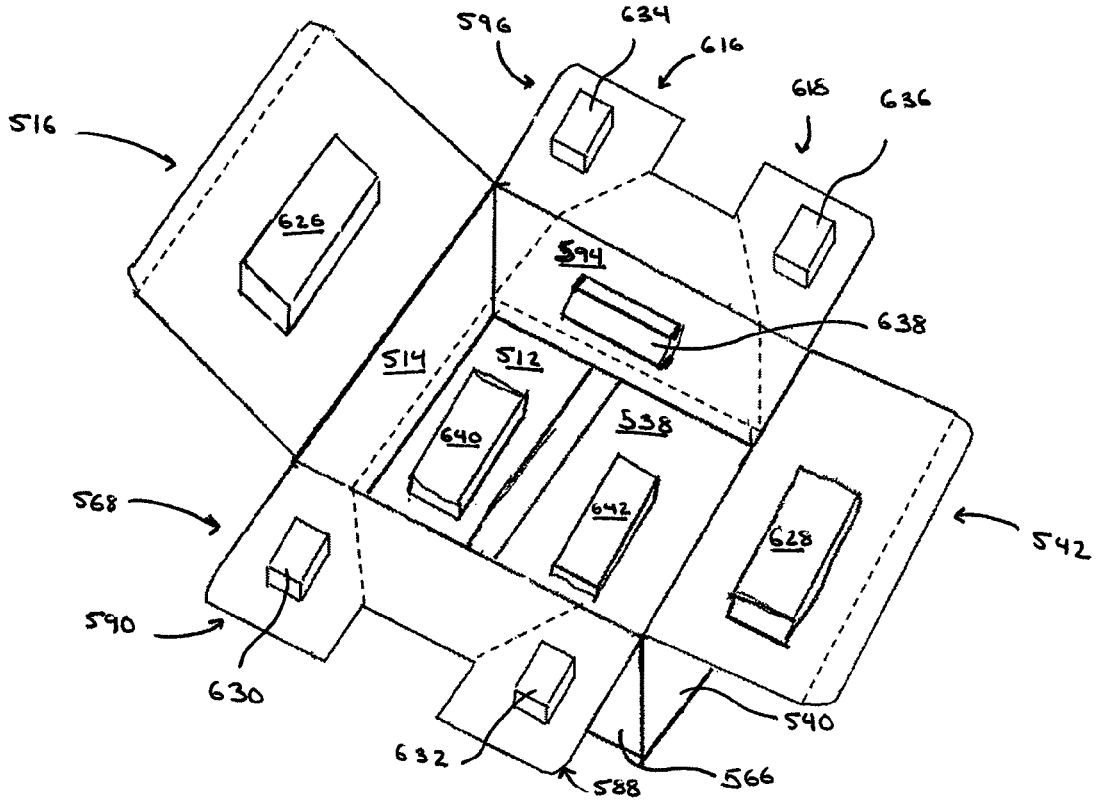
FIG. 26 is a perspective view of the shipping container of FIG. 24 in an open, expanded state, including an example of a layout of cushions attached to various parts thereof.

With reference to FIG. 26, the bottom panels 512, 538, 564, 592 have been folded upwardly so as to close the bottom of the container 500. The container 500 can include at least one or more cushions. In some embodiments, the cushions can be securely attached to various components of the outer assembly 102. For example, cushions 626, 628 can be attached to lid panels 516, 542, cushions 630, 632, 634, 636, can be attached to top panels 568, 596, cushion 638 can be attached to side wall panel 594 (a separate cushion, not shown, can be attached to side wall panel 566), and cushions 640, 642 can be attached to bottom panels 512, 538.

Optionally, one or more cushions can be simply placed inside the open cavity of the container 500 without being adhered or connected to the inner surfaces of the various portions of the assembly 502. For example, in some embodiments, although not illustrated, the container 500 can include four pieces, approximately the same size as the end and side panels 524, 550, 566, 594, as well as a cushion that is approximately the size of the bottom formed by the bottom panels, 512, 538, 564, 592. Additionally, a further top cushion can be included which can be approximately the same size or smaller than the bottom portion noted above. The cushions can be made from any of the materials noted above, or other materials.

Figure 27:
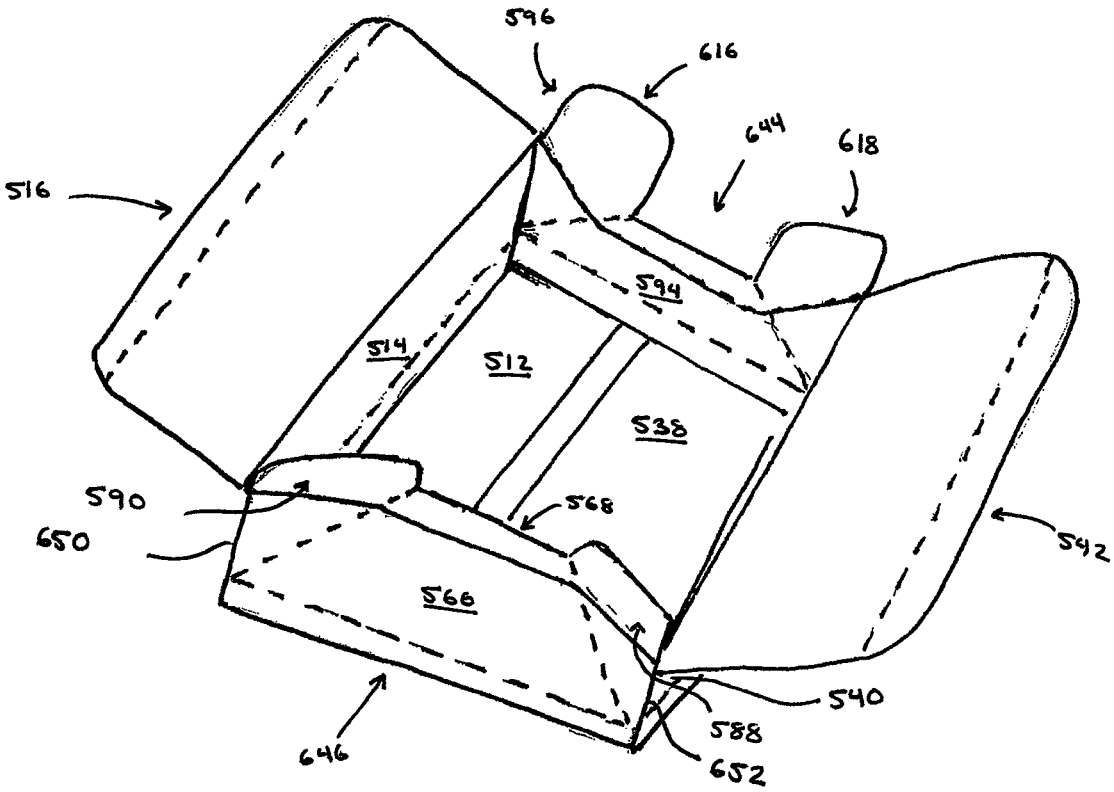
FIG. 27 is a perspective view of the shipping container of FIG. 24, in an intermediate step in the process of compressing the container into a compressed state, with the cushions removed.

With reference to FIG. 27, as noted above, the fold lines 580, 582, 608, 610 can be configured to allow the side sections 508, 510 to be collapsed inwardly toward the inner cavity of the container 500. For example, if a force is applied in the direction of the arrows 644, 646, central portions of the upper portions 576, 604 of side wall panels 566, 594 can fold inwardly and thus pivot and rotate toward the bottom of the container 500 formed by the bottom panels 512, 538, 564, 592. Because the upper portions 576, 604 of side wall panels 566, 594 are pivotably connected to the upper portions 524, 550 of end wall panels 514, 540, this movement also causes the upper portions 524, 550 of end wall panels 514, 540 to also fold downwardly towards the bottom of the container 500. As described above, this movement is similar to the movement of leaves of a blossoming flower or the wings of a bird when a bird moves its wings from an outstretched position to a swept back position.

With continued reference to FIG. 27, it should be noted that the upper portions 576, 604 of side wall panels 566, 594 and the upper portions 524, 550 of end wall panels 514, 540 can rotate about fold lines 578, 606, 526, 552 respectively. As such, the lower portions 522, 548 of the end wall panels 514, 540 and the lower portions 574, 602 of the side wall panels 566, 594 can remain oriented in a generally upright position while the upper portions 524, 550, 576, 604 are folded inwardly towards the bottom of the container 500. The upright orientation of the lower portions 522, 548, 574, 602 can advantageously form the sides and ends of the "reservoir" volume 648 which will be discussed below in further detail in connection with FIG. 30.

During the conversion from an expanded state to a compressed state, the lateral end portions of the side wall panel 566 simultaneously pivots along the fold lines 580, 582 and the lateral ends 650, 652 of the side wall panel 566 where it is attached to the end wall panels 514, 540. Additionally, the wing portions 588, 590 also pivot along the fold lines 580, 582 away from the bottom of the container 500 toward the position illustrated in FIG. 28 (a top plan view). It should be noted that side wall panel 594 and wing portions 616, 618 perform a similar pivoting action during this conversion.

Figure 28:
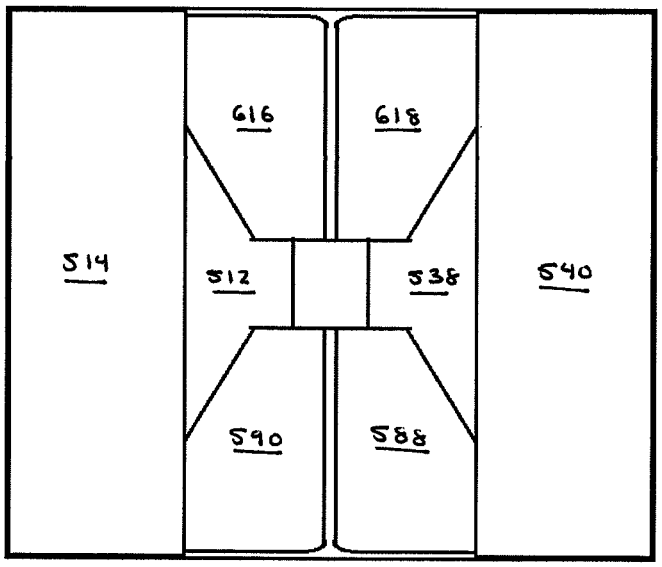
FIG. 28 is a top plan view of the shipping container of FIG. 24, in a fully compressed state, with certain lid portions removed to more clearly illustrate the configuration.

With continued reference to FIG. 28, the continued movement of the various panels causes the wings 588, 590, 616, 618 to be folded inwardly towards the central portion of the side wall panels 566, 594 and towards one another. Eventually, as the side wall panels 566, 594 are continued to be folded inwardly, the wings 588, 590, 616, 618 can be folded such that they are contained completely within the footprint of the bottom of the container 500 as illustrated. The lid panels 516, 542 have been removed from the top plan view of FIG. 28 so as to provide a more clear view of the side sections 508, 510 in the compressed state.

Figure 29:
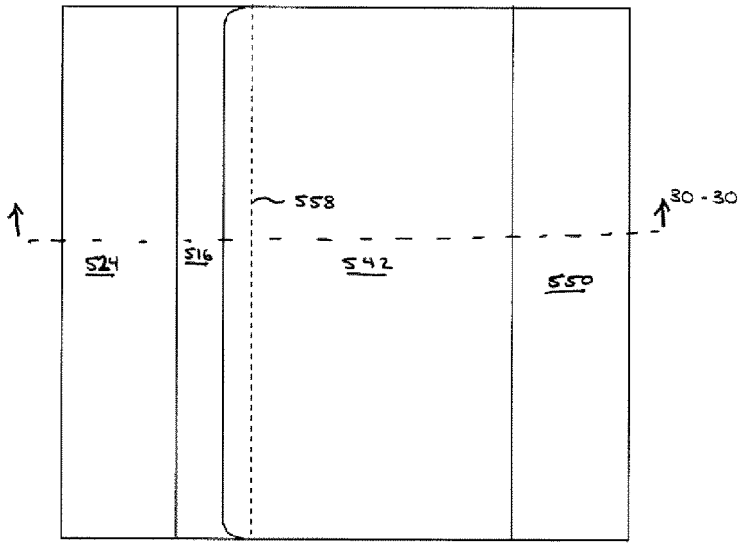
FIG. 29 is a top plan view of the shipping container of FIG. 24, in a fully compressed state, with all lid portions shown.

With reference to FIG. 29, the side panels 124, 126 have been fully folded inwardly and the entirety of the side wall panels 566, 594 and wings 588, 590, 616, 618 are entirely disposed within the footprint defined by the bottom of the container 500. Additionally, the lid panels 516, 542 can be folded on top of one another to cover the interior of the container 500.

Figure 30:
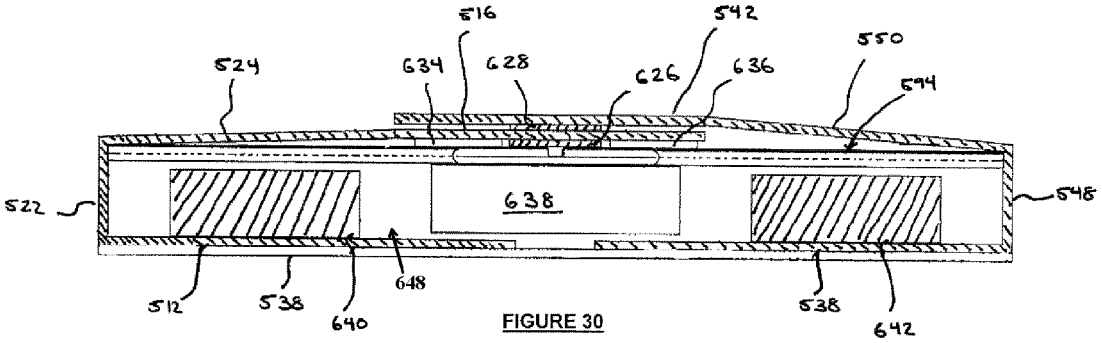
FIG. 30 is a sectional view taken along the line 30-30 of FIG. 29, with the shipping container in a fully compressed state and within a retention member.

With reference to FIG. 30, which is a cross-sectional view of the container 500 taken along line 30-30 of FIG. 29, the various panels and portions of the container 500 have been folded one on top of another so as to convert the container and the outer assembly 502 into a compressed state. As shown in the illustrated embodiment, certain of the cushions, such as cushions 638, 640, 642 can remain in a non-compressed state and cushions 626, 628, 634, 636 can be compressed from their free expanded state.

As more clearly illustrated in FIG. 30, the container 500 can include a "reservoir" volume 648 with side walls formed by the lower portions 522, 548, 574, 602 of the end wall panels 514, 540 and side wall panels 566, 594. Accordingly, the height of the "reservoir" volume can, in some embodiments, be approximately the distance between the edges 518, 544, 570, 598 and fold lines 526, 552, 578, 606 (i.e., the "width" of the lower portions). Of course, the lower portions 522, 548, 574, 602 need not be completely vertical and can be angled either outwardly from the bottom portion 404 or inwardly towards the bottom portion 404.

As should be apparent, in some embodiments, the bottom panels 512, 538, 564, 592 can remain relatively unaltered during the transition from the expanded state to the compressed state. Accordingly, an end user need not worry about ensuring that the bottom portion of the container 500 is properly configured each time the end user transitions the container 500 from a compressed state to an expanded state and vice versa. This can advantageously allow the manufacturer of the container 500 to form the bottom portion, such as by using an adhesive such as tape or glue, welding, or other techniques known in the art. Furthermore, as herein discussed, in some embodiments, the side wall panels 566, 594 and end wall panels 514, 540 can be formed solely by folding along the fold lines. Accordingly, at least five sides of the container can be formed upon delivery to an end user. As should be apparent, this advantage applies to other containers as herein discussed.

As discussed above in connection with FIGS. 21-23, the "reservoir" volume 648 can reduce the forces exerted upon the outer assembly 502 when the container is in a compressed state. For example, as shown in the illustrated embodiment, the "reservoir" volume 648 can reduce or eliminate compression of some or all of the cushions from their free expanded state. As noted above, cushions 638, 640, 642 can remain in a non-compressed state. Furthermore, even in embodiments of the container 500 not having cushions, the "reservoir" volume 648 can reduce stresses caused by bending the outer assembly 502 into a compressed state.

It should be noted that while the "reservoir" volumes 442, 648 have been illustrated as having a volume to accommodate cushions and/or panels to alleviate forces and stresses upon the panels of the containers 400, 500, the "reservoir" volume need not be limited to this purpose. Rather, the incorporation of "reservoir" volumes 442, 648 allows the containers 400, 500 to have both a first volume (in the expanded state) and a second volume (in the compressed state). This can advantageously allow containers 400, 500 to be used for both larger and smaller items thereby enhancing the flexibility of the container 400, 500. A significant advantage is provided in the fact that the container 400, 500 can be converted from the first volume to the second volume without any permanent modification to the container.

Optionally, the container 500 can be secured into the fully compressed orientation illustrated in FIGS. 29 and 30 with a securement device (not shown) similar to securement devices 40, 170. In some embodiments, the securement device can be the type of device which is acceptable to have on the outside of a container for shipping through commercial shipping providers. Thus, the securement device can be a sleeve made out of corrugated cardboard, a strap, a string, tape, etc. In some embodiments, the securement device can be a plastic envelope and vacuum sealed so as to provide additional compressive force.

As a dimensional example, if the container 500, in the configuration illustrated in FIG. 26, were closed with the top panels 516, 542, 568, 596 folded inwardly so as to form a cubic container, in some embodiments, it can have the dimensions of 19"×16"×5.5". Similarly to the embodiment to the container 100 described above, in the compressed configuration illustrated in FIGS. 29 and 30, the container 500 can have approximate dimensions of 19"×16"×1.75". As such, the total volume occupied by the container is reduced by approximately 70%.

Figure 31:
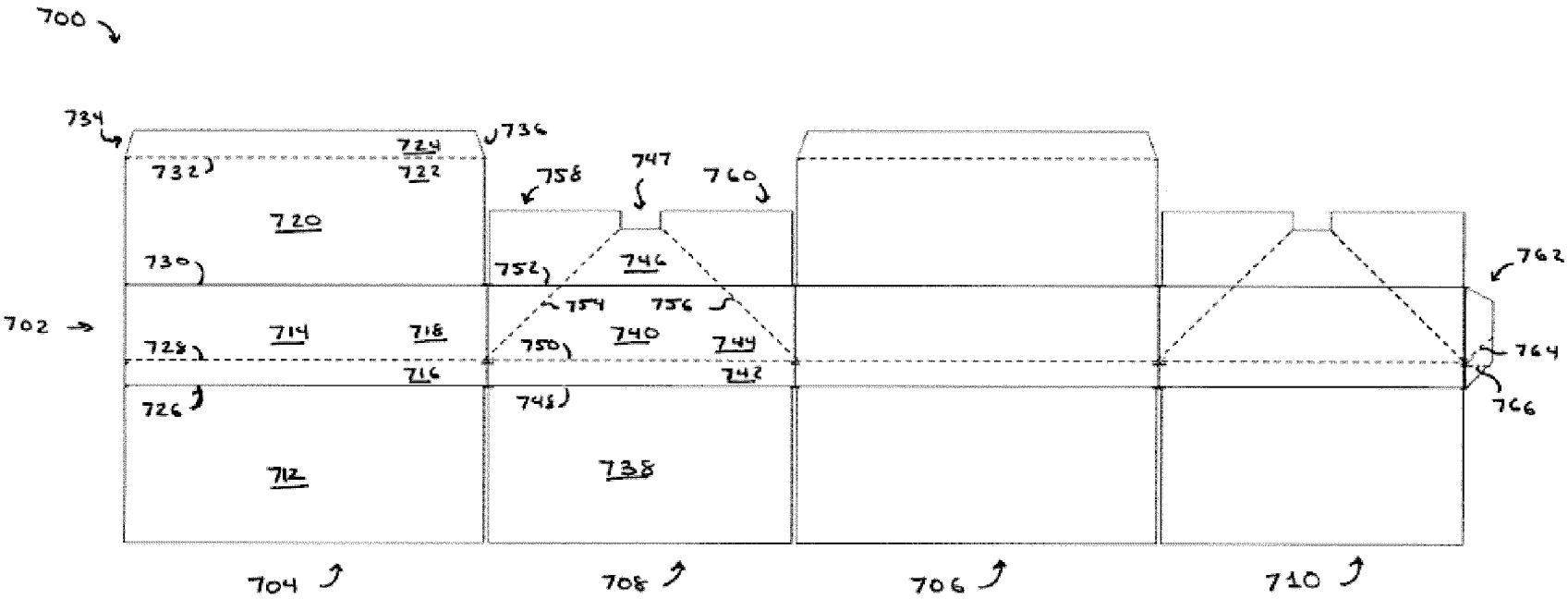
FIG. 31 is a schematic layout of another embodiment of a shipping container in a configuration pre-assembly.

FIG. 31 illustrates a further embodiment of the containers 10, 100, 400, 500 which is identified generally by the reference numeral 700. The container 700 is configured to be foldable between expanded and compressed states, similarly to that of containers 10, 100, 400, 500. The description set forth above with regard to the materials and manufacturing techniques of the containers 10, 100, 400, 500 apply equally to the container 700.

The container 700 can be formed from one or more pieces of a rigid material so as to form an outer assembly 702 of the container 700. The outer assembly 702 can be formed from any of the materials noted above with regard to the assemblies 12, 112, 402, 502 or other materials.

The outer assembly 702 can include a plurality of sections defining different portions of the resulting outer assembly illustrated in FIG. 31. For example, the outer assembly 702 can include side sections 704, 706 and end sections 708, 710. In the illustrated embodiment, each of the sections 704, 706, 708, 710 include portions for forming parts of a bottom and a top of the container 700. Additionally, the side sections 704, 706 include a portion defining side walls of the container 700. Similarly, the end sections 708, 710 include portions for forming end walls of the container 700.

With continued reference to FIG. 31, similar to section 504 of container 500, side section 704 can include a bottom panel 712, a side wall panel 714 having a lower portion 716 and an upper portion 718, and a lid or top panel 720 with a lower portion 722 and an upper portion 724 each pivotably connected by fold lines 726, 728, 730, 732. As discussed above with respect to FIGS. 20-30, this arrangement of fold lines along can result in the creation of a "reservoir" volume when the container 700 is in a compressed state. In some embodiments, the lid panel 720 can include tapered portions 734, 736 which can be sized and shaped to provide further clearance during the movement of the container 700 from an expanded state to a compressed state and vice versa. Such tapered portions (not shown) can also be included on the bottom panel 712.

For purposes of brevity, it will simply be noted that the arrangement of panels and fold lines of side section 706 can be similar to panels 712, 714, 720 and fold lines 726, 728, 730, 732 of side section 704.

Similar to section 508 of container 500, end section 708 can include a bottom include a bottom panel 738, an end wall panel 740 having a lower portion 742 and an upper portion 744, and a lid or top panel 746 having a notch or cutout 747, each panel being pivotably connected by fold lines 748, 750, 752. Furthermore, in some embodiments, the container 700 can include fold lines 754, 756 defining wings 758, 760. As discussed above in connection with FIGS. 24-30, this arrangement of fold lines can allow the assembly 702 to collapse inwardly during folding of the container 700 from an expanded state to a compressed state.

For purposes of brevity, it will simply be noted that the arrangement of panels and fold lines of end section 710 can be similar to panels 738, 740, 746 and fold lines 748, 750, 752 of end section 708.

As with the outer assembly 502 of container 500, the outer assembly 702 can optionally include a closure tab 762. The closure tab 762 can extend from an end section 710 or another portion of the assembly 702, so as to facilitate fixation of a free edge of the end wall section 710 to a free edge of the side wall section 704, using techniques well known in the art. The closure tab 762 can include a fold line 764, 766 to reduce the likelihood of interfering with the folding of the assembly 702 when fully assembled.

It should be appreciated that the lid or top panels having fold lines for facilitating the inward collapsibility of the container can be included on a section having any width relative to adjacent sections. For example, in some embodiments, the top panel, such as top panels 132, 134, 584, 612, can be included on sections, such as sections 108, 110, 508, 510, having a width greater than adjacent sections, such as sections 104, 106, 504, 506. In some embodiments, the top panel, such as top panel 746, can be included on sections, such as section 708, having a width less than adjacent sections, such as sections 704, 706. Although not shown, such a top panel can also be included on sections with widths equal to those of adjacent sections.

Figure 32:
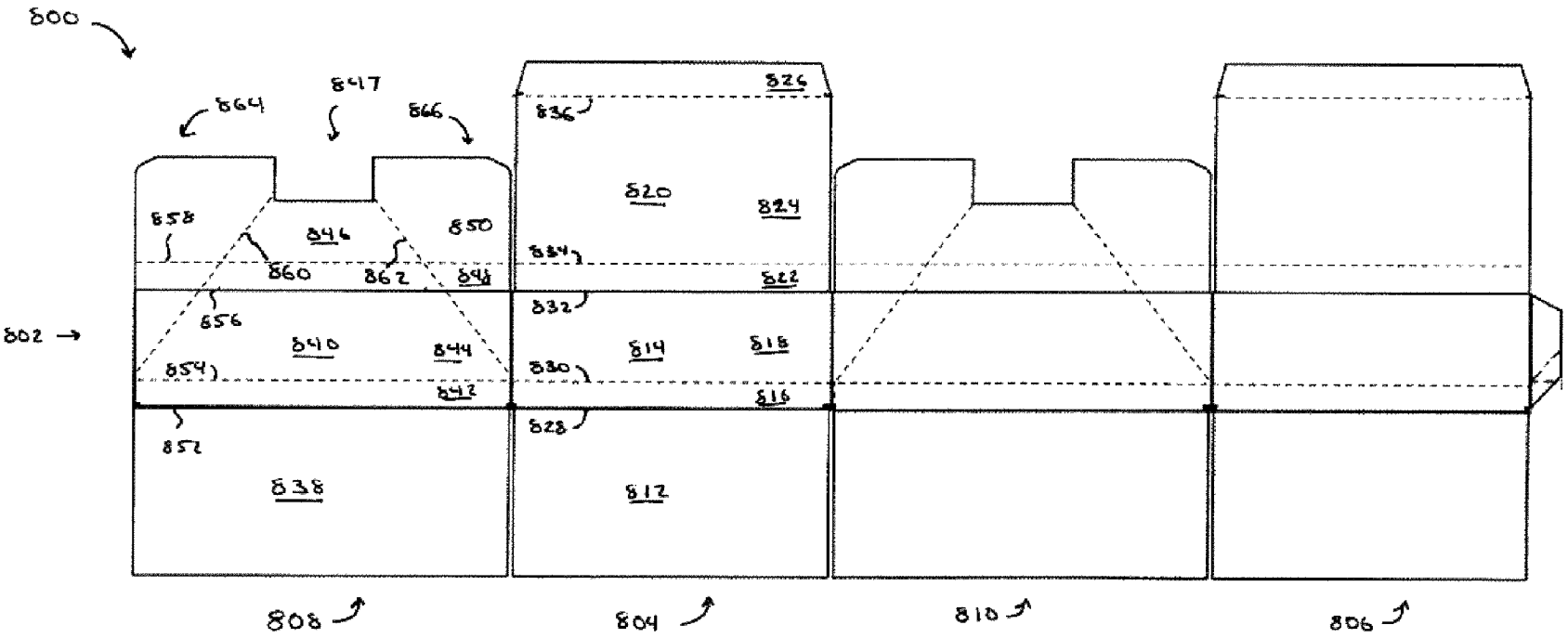
FIG. 32 is a schematic layout of another embodiment of a shipping container in a configuration pre-assembly.

FIG. 32 illustrates a further embodiment of the containers 10, 100, 400, 500, 700 which is identified generally by the reference numeral 800. The container 800 is configured to be foldable between expanded and compressed states, similarly to that of containers 10, 100, 400, 500, 700. The description set forth above with regard to the materials and manufacturing techniques of the containers 10, 100, 400, 500, 700 apply equally to the container 800.

The container 800 can be formed from one or more pieces of a rigid material so as to form an outer assembly 802 of the container 800. The outer assembly 802 can be formed from any of the materials noted above with regard to the assemblies 12, 112, 402, 502, 702 or other materials.

The outer assembly 802 can include a plurality of sections defining different portions of the resulting outer assembly 802 illustrated in FIG. 32. For example, the outer assembly 802 can include end sections 804, 806 and side sections 808, 810. In the illustrated embodiment, each of the sections 804, 806, 808, 810 include portions for forming parts of a bottom and a top of the container 800. Additionally, the end sections 804, 806 include a portion defining end walls of the container 800 and the side sections 808, 810 include portions for forming side walls of the container 800.

With continued reference to FIG. 32, the construction of end section 804 can be similar to that of sections 504, 704 as herein described. As illustrated in FIG. 32, end section 804 can include a bottom panel 812, an end wall panel 814 having a lower portion 816 and an upper portion 818, and a lid or top panel 820 with the lid panel 820 having multiple portions 822, 824, 826. Fold lines 828, 830, 832, 834, 836 can allow the multiple panels and portions to be pivotable relative to one another.

For purposes of brevity, it will simply be noted that the arrangement of panels and fold lines of end section 806 can be similar to panels and portions 812, 814, 816, 818, 820, 822, 824, 826 and fold lines 828, 830, 832, 834, 836 of end section 804.

The construction of side wall sections 808 can be similar to that of sections 508, 708 as herein described. The side wall section 808 can include a bottom panel 838, a side wall panel 840 having a lower portion 842 and an upper portion 844, and a lid or top panel 846 having a notch or cutout 847. As with lid panel 820, top panel 846 can include multiple portions 848, 850. Fold lines 852, 854, 856, 858 can allow the multiple panels and portions to be pivotable relative to one another. Furthermore, in some embodiments, the container 800 can include fold lines 860, 862 defining wings 864, 866. As discussed above in connection with FIGS. 24-31, this arrangement of fold lines can allow the assembly 802 to collapse inwardly during folding of the container 800 from an expanded state to a compressed state.

For purposes of brevity, it will simply be noted that the arrangement of panels and fold lines of side wall section 810 can be similar to panels and portions 838, 840, 842, 844, 846, 848, 850 and fold lines 852, 854, 856, 858, 860, 862 of side section 808.

The inclusion of multiple portions for the lid and top panels of the assembly 802 can allow the container 802 to be suitable for a wider variety of packaging needs by allowing an end user to select a depth for the container 802. For example, if the end user prefers a container 802 having a greater depth, the end user can fold the lid and top panels along the upper fold line (e.g., fold lines 834, 858). The end user can then, if desirable, seal the openings between the upright portions of the lid and top panels when the container 802 is fully assembled with the lid and top panels closed. If the end user prefers a container 802 having a smaller depth, the user can instead fold the lid and top panels along the lower fold line (e.g., fold lines 832, 856). Such additional fold lines can also be included on the bottom panels for the same effect. Furthermore, such additional fold lines can be used on containers having no "reservoir" volume.

Although the present inventions have been described in terms of certain embodiments, other embodiments apparent to those of ordinary skill in the art also are within the scope of these inventions. Thus, various changes and modifications may be made without departing from the spirit and scope of the inventions. For instance, various components may be repositioned as desired. Moreover, not all of the features, aspects and advantages are necessarily required to practice the present inventions.

What is claimed is:

1. A shipping container for containing and protecting an article during transport, comprising:

at least one cushion; and an outer container, the at least one cushion being disposed in the outer container, the outer container being foldable between at least first and second states, wherein when in the first state, the outer container forms a closed shipping container sized to encompass a first volume of space sufficient to enclose an article and cushion the article with the at least one cushion, and wherein in the second state, the outer container is folded into a compressed state having a reservoir volume, the reservoir volume being sized to reduce compression of the at least one cushion when the outer container is in the second state;

wherein the outer container comprises at least a bottom wall and at least first and second side wall panels and first and second end wall panels connected to the bottom wall, wherein the first and second side wall panels and the first and second end wall panels each comprise a lower portion and an upper portion pivotable about a fold line.

2. The shipping container according to claim 1, wherein the lower portions of the first and second side wall panels and first and second end wall panels form sides of the reservoir volume and the bottom wall forms a bottom portion of the reservoir volume.

3. The shipping container according to claim 1, wherein at least the first and second sidewall panels include upper and lower edges and left and right lateral edges, and at least one fold line extending across the sidewall panel and along a direction skewed relative to the upper and lower edges and the left and right lateral edges.

4. The shipping container according to claim 3, wherein the outer container further comprises at least one top panel portion pivotably attached to the upper edge of the first sidewall panel, the top panel portion having a U-shape.

5. The shipping container according to claim 4, wherein the at least one top panel portion includes at least first and second wing portions defining the U-shape.

6. The shipping container according to claim 5 wherein a bight portion of the U-shaped top panel portion is disposed between the first and second wing portions, and wherein the at least one fold line extends to the bight portion.

7. The shipping container according to claim 1, further comprising a lid portion.

8. This shipping container according to claim 7, further comprising fold lines along at least one of panels forming the bottom wall or panels forming the lid portion, the fold lines allowing the container to be foldable into at least a third state, the third state having a volume greater than the first state and second state.

9. The shipping container according to claim 1, further comprising a securement device configured to retain the outer container in the compressed state.

10. The shipping container according to claim 1, wherein the bottom wall remains unaltered during the transition from the first state to the second state and from the second state to the first state.

11. A shipping container configured for containing and protecting an article during transportation, comprising:

an outer container assembly comprising one or more pieces of planar substrate material defining at least a bottom wall and a plurality of side walls connected to the bottom wall, the one or more pieces of planar substrate material being foldable between a first collapsed configuration in which the bottom and plurality of sidewalls form a first reservoir volume and a second deployed configuration in which the bottom wall and the plurality of sidewalls form a second volume that is larger than the first volume;

wherein each side wall of the plurality of side walls comprises a lower portion and an upper portion, the upper portion pivotably connected to the corresponding lower portion along a fold line and the lower portion connected to the bottom wall, the lower portions of the plurality of side walls forming the sides of the reservoir volume when the shipping container is in the collapsed configuration.

12. The shipping container according to claim 11, wherein the one or more pieces of planar substrate material are configured to form a complete outer container appropriate for shipping when the outer container assembly is in the compressed state and when in the deployed configuration.

13. The shipping container according to claim 11, further comprising a lid portion.

14. The shipping container according to claim 13:

wherein the bottom wall comprises a plurality of bottom panels and the lid portion comprises a plurality of lid panels; and further comprising fold lines along at least one of the plurality of panels forming the bottom wall or panels forming the lid portion, the fold lines allowing the container to be foldable into at least a third state, the third state having a volume greater than the first state and second state.

15. The shipping container according to claim 11, wherein the one or more pieces of planar substrate material for a generally rectangular box.

16. The shipping container according to claim 11, further comprising a retention member configured to retain the outer container assembly in the compressed state against a bias of a first cushion member.

17. The shipping container according to claim 11, wherein the bottom wall remains unaltered during the transition from the first state to the second state and from the second state to the first state.

* * * * *